US008350143B2

(12) United States Patent
Fujiwara et al.

(10) Patent No.: US 8,350,143 B2
(45) Date of Patent: Jan. 8, 2013

(54) KEYBOARD MUSICAL INSTRUMENT

(75) Inventors: Yuji Fujiwara, Hamamatsu (JP); Tsutomu Sasaki, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 193 days.

(21) Appl. No.: 13/013,198

(22) Filed: Jan. 25, 2011

(65) Prior Publication Data

US 2011/0185876 A1 Aug. 4, 2011

(30) Foreign Application Priority Data

Feb. 2, 2010 (JP) ..... 2010-021355

(51) Int. Cl.
*G10H 1/00* (2006.01)

(52) U.S. Cl. ..... 84/615; 84/653

(58) Field of Classification Search ..... 84/615, 84/626, 647, 653, 670
See application file for complete search history.

(56) References Cited

U.S. PATENT DOCUMENTS

| | | | | |
|---|---|---|---|---|
| 6,084,168 | A * | 7/2000 | Sitrick | 84/477 R |
| 6,969,791 | B2 * | 11/2005 | Fujiwara | 84/13 |
| 6,992,241 | B2 * | 1/2006 | Fujiwara | 84/21 |
| 7,279,630 | B2 * | 10/2007 | Sasaki et al. | 84/723 |
| 7,285,715 | B2 * | 10/2007 | Sasaki et al. | 84/737 |
| 7,361,827 | B2 * | 4/2008 | Sasaki | 84/723 |
| 7,361,828 | B2 * | 4/2008 | Sasaki | 84/743 |
| 7,381,880 | B2 * | 6/2008 | Fujiwara et al. | 84/615 |
| 7,521,627 | B2 * | 4/2009 | Sasaki | 84/735 |
| 7,598,448 | B2 * | 10/2009 | Ohba | 84/626 |
| 2005/0092164 | A1 * | 5/2005 | Fujiwara | 84/645 |
| 2005/0145087 | A1 * | 7/2005 | Fujiwara | 84/1 |
| 2005/0211048 | A1 * | 9/2005 | Fujiwara | 84/13 |
| 2006/0053999 | A1 * | 3/2006 | Sasaki | 84/13 |
| 2006/0185503 | A1 * | 8/2006 | Fujiwara | 84/626 |
| 2006/0201313 | A1 * | 9/2006 | Sasaki et al. | 84/626 |
| 2006/0213357 | A1 * | 9/2006 | Ohba | 84/723 |
| 2008/0156181 | A1 * | 7/2008 | Sasaki | 84/743 |
| 2010/0229707 | A1 * | 9/2010 | Sasaki | 84/20 |
| 2010/0288102 | A1 * | 11/2010 | Fujiwara et al. | 84/13 |
| 2011/0185876 | A1 * | 8/2011 | Fujiwara et al. | 84/21 |

FOREIGN PATENT DOCUMENTS

| | | |
|---|---|---|
| JP | 2009-020455 | 1/2009 |

* cited by examiner

*Primary Examiner* — David S. Warren
(74) *Attorney, Agent, or Firm* — Harness, Dickey & Pierce, PLC

(57) ABSTRACT

A keyboard musical instrument provides plural keys of a keyboard to be driven by an automatic playing system; although the automatic playing system selectively drives the keys in accordance with a performance rule expressing a music tune, a motion controller of the automatic playing system changes the performance rule if the human player drives the keys different from those defined in the performance rule so that the automatic playing system changes a part of the music tune in real time fashion during the automatic performance.

10 Claims, 20 Drawing Sheets

310

320

| i | 0 | 1 | 2 | 3 | 4 | 5 | 6 | 7 | 8 | 9 | 10 |
|---|---|---|---|---|---|---|---|---|---|---|---|
| gk[i] | 0 | 0 | 0 | 2 | 2 | 2 | 2 | -1 | -1 | -1 | -1 |
| gtp[i] | 1000 | 1000 | 1000 | 1000 | 1000 | 1000 | 1000 | 1000 | 1000 | 1000 | 1000 |
| gvp[i] | 0 | 0 | 0 | 0 | 0 | 0 | 0 | 0 | 0 | 0 | 0 |
| gtn[i] | 1000 | 1000 | 1000 | 1000 | 1000 | 1000 | 1000 | 1000 | 1000 | 1000 | 1000 |
| gvn[i] | 0 | 0 | 0 | 0 | 0 | 0 | 0 | 0 | 0 | 0 | 0 |
| rk[i] | 40 | 40 | 40 | 44 | 46 | 48 | 50 | 46 | 45 | 44 | 43 |
| rtp[i] | 1000 | 2000 | 3000 | 4000 | 5000 | 6000 | 7000 | 8000 | 9000 | 10000 | 11000 |
| rvp[i] | 64 | 64 | 64 | 64 | 64 | 64 | 64 | 64 | 64 | 64 | 64 |
| rtn[i] | 1500 | 2500 | 3500 | 4500 | 5500 | 6500 | 7500 | 8500 | 9500 | 10500 | 11500 |
| rvn[i] | 64 | 64 | 64 | 64 | 64 | 64 | 64 | 64 | 64 | 64 | 64 |
| yk[i] | 40 | 40 | 42 | 44 | 46 | 48 | 47 | 46 | 45 | 44 | 43 |
| ytp[i] | 1000 | 2000 | 3000 | 4000 | 5000 | 6000 | 7000 | 8000 | 9000 | 10000 | 11000 |
| yvp[i] | 64 | 64 | 64 | 64 | 64 | 64 | 64 | 64 | 64 | 64 | 64 |
| ytn[i] | 1500 | 2500 | 3500 | 4500 | 5500 | 6500 | 7500 | 8500 | 9500 | 10500 | 11500 |
| yvn[i] | 64 | 64 | 64 | 64 | 64 | 64 | 64 | 64 | 64 | 64 | 64 |
| ek[i] | 0 | 0 | 2 | 0 | 0 | 0 | -3 | 0 | 0 | 0 | 0 |
| etp[i] | 0 | 0 | 0 | 0 | 0 | 0 | 0 | 0 | 0 | 0 | 0 |
| evp[i] | 0 | 0 | 0 | 0 | 0 | 0 | 0 | 0 | 0 | 0 | 0 |
| etn[i] | 0 | 0 | 0 | 0 | 0 | 0 | 0 | 0 | 0 | 0 | 0 |
| evn[i] | 0 | 0 | 0 | 0 | 0 | 0 | 0 | 0 | 0 | 0 | 0 |

Fig. 8

310

320

| i | 0 | 1 | 2 | 3 | 4 | 5 | 6 | 7 | 8 | 9 | 10 |
|---|---|---|---|---|---|---|---|---|---|---|---|
| gk[i] | 0 | 0 | 0 | 1 | 1 | 1 | 1 | -1 | -1 | -1 | -1 |
| gtp[i] | 1000 | 1000 | 1000 | 1000 | 1000 | 1000 | 1000 | 1000 | 1000 | 1000 | 1000 |
| gvp[i] | 0 | 0 | 0 | 3 | 3 | 3 | 3 | 17 | 17 | 17 | 17 |
| gtn[i] | 1000 | 1000 | 1000 | 1000 | 1000 | 1000 | 1000 | 1000 | 1000 | 1000 | 1000 |
| gvn[i] | 0 | 0 | 0 | -2 | -2 | -2 | -2 | -17 | -17 | -17 | -17 |
| rk[i] | 1 | 1 | 1 | 3 | 4 | 5 | 6 | 3 | 2 | *1* | *1* |
| rtp[i] | 1000 | 2000 | 3000 | 4000 | 5000 | 6000 | 7000 | 8000 | 9000 | 10000 | 11000 |
| rvp[i] | 64 | 64 | 64 | 70 | 73 | 76 | 79 | 110 | *127* | *127* | *127* |
| rtn[i] | 1500 | 2500 | 3500 | 4500 | 5500 | 6500 | 7500 | 8500 | 9500 | 10500 | 11500 |
| rvn[i] | 64 | 64 | 64 | 60 | 58 | 56 | 54 | 22 | 5 | *1* | *1* |
| yk[i] | 1 | 1 | 2 | 3 | 4 | 5 | 4 | 3 | 2 | 1 | 1 |
| ytp[i] | 1000 | 2000 | 3000 | 4000 | 5000 | 6000 | 7000 | 8000 | 9000 | 10000 | 11000 |
| yvp[i] | 64 | 64 | 67 | 70 | 73 | 76 | 93 | 110 | 127 | 127 | 127 |
| ytn[i] | 1500 | 2500 | 3500 | 4500 | 5500 | 6500 | 7500 | 8500 | 9500 | 10500 | 11500 |
| yvn[i] | 64 | 64 | 62 | 60 | 58 | 56 | 39 | 22 | 5 | 1 | 1 |
| ek[i] | 0 | 0 | 1 | 0 | 0 | 0 | -2 | 0 | 0 | 0 | 0 |
| etp[i] | 0 | 0 | 0 | 0 | 0 | 0 | 0 | 0 | 0 | 0 | 0 |
| evp[i] | 0 | 0 | 3 | 0 | 0 | 0 | 14 | 0 | 0 | 0 | 0 |
| etn[i] | 0 | 0 | 0 | 0 | 0 | 0 | 0 | 0 | 0 | 0 | 0 |
| evn[i] | 0 | 0 | -2 | 0 | 0 | 0 | -15 | 0 | 0 | 0 | 0 |

Fig. 11

310

320

| i | 0 | 1 | 2 | 3 | 4 | 5 | 6 | 7 | 8 | 9 | 10 |
|---|---|---|---|---|---|---|---|---|---|---|---|
| gk[i] | 0 | 0 | 0 | 2 | 2 | 2 | 2 | 0 | 0 | 0 | 0 |
| gtp[i] | 1000 | 1000 | 1000 | 1000 | 1000 | 1000 | 1000 | 1000 | 1000 | 1000 | 1000 |
| gvp[i] | 0 | 0 | 0 | 0 | 0 | 0 | 0 | 0 | 0 | 0 | 0 |
| gtn[i] | 1000 | 1000 | 1000 | 1000 | 1000 | 1000 | 1000 | 1000 | 1000 | 1000 | 1000 |
| gvn[i] | 0 | 0 | 0 | 0 | 0 | 0 | 0 | 0 | 0 | 0 | 0 |
| rk[i] | 40 | 40 | 40 | 42 | 44 | 46 | 48 | 48 | 48 | 48 | 48 |
| rtp[i] | 1000 | 2000 | 3000 | 4000 | 5000 | 6000 | 7000 | 8000 | 9000 | 10000 | 11000 |
| rvp[i] | 64 | 64 | 64 | 64 | 64 | 64 | 64 | 64 | 64 | 64 | 64 |
| rtn[i] | 1500 | 2500 | 3500 | 4500 | 5500 | 6500 | 7500 | 8500 | 9500 | 10500 | 11500 |
| rvn[i] | 64 | 64 | 64 | 64 | 64 | 64 | 64 | 64 | 64 | 64 | 64 |
| yk[i] | 40 | 40 | 42 | 42 | 44 | 46 | 46 | 48 | 48 | 48 | 48 |
| ytp[i] | 1000 | 2000 | 3000 | 4000 | 5000 | 6000 | 7000 | 8000 | 9000 | 10000 | 11000 |
| yvp[i] | 64 | 64 | 64 | 64 | 64 | 64 | 64 | 64 | 64 | 64 | 64 |
| ytn[i] | 1500 | 2500 | 3500 | 4500 | 5500 | 6500 | 7500 | 8500 | 9500 | 10500 | 11500 |
| yvn[i] | 64 | 64 | 64 | 64 | 64 | 64 | 64 | 64 | 64 | 64 | 64 |
| ek[i] | 0 | 0 | 2 | 0 | 0 | 0 | -2 | 0 | 0 | 0 | 0 |
| etp[i] | 0 | 0 | 0 | 0 | 0 | 0 | 0 | 0 | 0 | 0 | 0 |
| evp[i] | 0 | 0 | 0 | 0 | 0 | 0 | 0 | 0 | 0 | 0 | 0 |
| etn[i] | 0 | 0 | 0 | 0 | 0 | 0 | 0 | 0 | 0 | 0 | 0 |
| evn[i] | 0 | 0 | 0 | 0 | 0 | 0 | 0 | 0 | 0 | 0 | 0 |

Fig. 14

KEYBOARD MUSICAL INSTRUMENT

FIELD OF THE INVENTION

This invention relates to a musical instrument and more particularly, to a keyboard musical instrument equipped with an electronic supporting system for giving support to a human player in playing a passage and a keyboard musical instrument equipped with an automatic regulating system for eliminating individualities of the keyboard musical instrument from performances.

DESCRIPTION OF THE RELATED ART

An automatic player musical instrument is defined as a combination of an acoustic musical instrument and an automatic playing system. Various automatic player musical instruments have been proposed, manufactured and sold in the market. One of the most popular automatic player musical instruments is fabricated on the basis of an acoustic piano, and is known as "an automatic player piano." For this reason, a typical example of the automatic player piano is hereinafter described as the prior art automatic player musical instrument.

The acoustic piano is well known to persons skilled in the art so that description is hereinafter briefly made on the acoustic piano. The acoustic piano is broken down into a cabinet, a keyboard, which includes plural black keys and plural white keys, and a mechanical tone generator. The black keys and white keys are linked in parallel with the mechanical tone generator. The black keys and white keys are used for specifying the pitch of acoustic piano tones, and the specified acoustic piano tones are generated by the mechanical tone generator.

The mechanical tone generator is fabricated from plural action units, plural dampers, plural hammers and plural strings. Each of the black and white keys is associated with one of the action units, one of the dampers, one of the hammers and one of the strings. The black key or white key is connected to the associated action unit and associated damper so that the depressed black key or depressed white key gives rise to actuation of the action unit and separation of the damper from the associated string. The hammer at the original position is opposed to the associated string, and the actuated action unit gives rise to free rotation of the hammer toward the associated string. The hammer is brought into collision with the associated string at the end of free rotation, and gives rise to an acoustic piano tone through the vibrations of string.

The automatic playing system includes an information processing system, solenoid-operated key actuators, plunger sensors, an electronic tone generator and a sound system, and the acoustic piano tones or electronic tones are generated in an automatic performance on the basis of pieces of music data without the fingering of a human player. The pieces of music data are prepared in accordance with MIDI (Musical Instrument Digital Interface) protocols, and a set of pieces of music data expresses a music tune on a whole music score.

The plunger sensors and solenoid-operated key actuators are connected to the information processing system, and pieces of plunger velocity data are periodically supplied from the sensors to the information processing system in the automatic performance. The plungers form parts of the solenoid-operated key actuators.

A computer program runs on the information processing system, and the pieces of music data are sequentially fetched by the information processing system. Reference key trajectories are prepared on the basis of the pieces of music data for each of the black keys and white keys to be depressed and each of the black and white keys to be released in the information processing system.

The reference key trajectory is a series of values of target key position on which the white key or black key is expected to travel. If the white key or black key accurately travels on the reference key trajectory toward the end position, the white key or black key passes a reference point, which is a predetermined intermediate point between the rest position and the end position, at a reference key velocity. The reference key velocity is well proportional to the final hammer velocity immediately before the collision with the string. Since the loudness of acoustic piano tone is proportional to the final hammer velocity so that the loudness of acoustic piano tone is controllable by adjusting the reference key velocity to a target value. On the other hand, the reference key trajectory for a released key makes the acoustic piano tone decayed at a target time.

When a user instructs the information processing system to reenact a music tune through the acoustic piano tones, the information processing system sequentially controls the solenoid-operated key actuators along the reference key trajectories with the comparison with the pieces of plunger velocity data, and the solenoid-operated key actuators move the black keys and white keys along the reference key trajectories. The depressed keys actuate the associated action units and associated dampers, and the acoustic piano tones are produced through the collision between the hammers and the strings. As a result, the music tune is reproduced through the acoustic piano tones. In this way, all of the music tunes are sequentially generated on the basis of the pieces of music data without any fingering of a human player.

If, on the other hand, the user instructs the information processing system to reenact the music tune through the electronic tones, the information processing system produces reference key trajectories for mute performance, and transfers the pieces of music data to the electronic tone generator. The solenoid-operated key actuators are controlled along the reference key trajectories, and an audio signal is produced on the basis of the pieces of music data in the electronic tone generator. The black keys and white keys travel on the reference key trajectory for mute performance. However, the hammers do not escape from the action units. In other words, the hammers do not start the free rotation. As a result, any acoustic piano tone is not produced. The audio signal is supplied to the sound system, and is converted to the electronic tones through the sound system.

Thus, the automatic playing system reproduces the music tune through the acoustic piano tones or electronic tones, and the black keys and white keys are sequentially depressed and released along the music tune for the acoustic piano tones or visual effect. Any human pianist is not involved in the standard automatic performance.

The automatic playing system is further available for assistance to a human player in a performance, and is hereinafter referred to as "automatic assistance". The automatic assistance aims at making beginners easily perform music tunes for senior pianists. An example of the automatic playing system for automatic assistance is disclosed in Japan Patent Application laid-open No. 2009-020455. The prior art automatic playing system is designed for human players who are weak in repetition. The repetition is a playing technique in which a human player is expected repeatedly to depress a key at high speed within a short time period. The prior art automatic playing system gives the assistance to the human players as follow. When a human player find a note to be performed in the repetition on a music score, he or she keeps the key assigned the note depressed to a certain intermediate position on the way to the end position for a time period longer than a predetermined time period. Then, the prior art automatic playing system notices the intention of human player through the sensor system, and the information processing system prepares a reference key trajectory for the repetition. The associated solenoid-operated key actuator makes the plunger repeatedly project and retracted along the reference key trajectory so that the key repeats the reciprocal movement at high speed. Thus, the human player performs the note in repetition without repeatedly depressing and releasing the key. Human pianists are involved in the automatic assistance.

The automatic playing system is further available for accompaniment or ensemble. "Automatic accompaniment" is defined as accompaniment or ensemble carried out by a human player and the automatic playing system. Thus, human players are involved in the automatic accompaniment. The human player may finger a music tune on the automatic player piano together with the built-in automatic playing system. A human player and automatic playing system may finger a melody and chords, respectively, or vice versa. A human player and automatic playing system may perform a piece of music in piano duet on a single automatic player piano through the automatic accompaniment.

While a human player is fingering a melody of a music tune on the automatic player piano, the automatic playing system selectively drives the black keys and white keys for producing chords in the automatic accompaniment. For this reason, the information processing system fetches the music data codes for the black keys and white keys to be depressed and released for producing the chords, and leaves the music data codes for the melody unprocessed.

A set of music data codes for a playback includes duration data codes and key-event data codes. Each of the key event data codes expresses a note-on key event or a note-off key event, and each of the duration data codes expresses a lapse of time from a key event, i.e., a note-on key event or note-off key event to the next key event. The pitch and loudness of a tone to be produced are specified in the note-on key event code, and the pitch of tone to be decayed is specified in the note-off key event code. The key event data codes and duration data codes are prepared before the automatic accompaniment, and the prior art automatic playing system does not have any capability to change and modify the key event data codes and duration data codes. However, human players does not always finger the black keys and white keys for a melody as expressed in the music data codes for the melody. A human player may slow down the progress of melody for his or her uniqueness. A human player may interpret the forte, seriously, but another human player does not do so. In this situation, the prior art automatic playing system can not respond to the uniqueness. As a result, the automatic accompaniment and the fingering of human player are not always well synchronized with each other.

Term "Passage" is defined in a Music Dictionary as "a section of a musical composition—semitones, not always, with the implication of not having much structural importance (e.g. when a piece is said to contain "showy passagework" for a soloist's display)." "Glissando" is an example of the passage. A human player may wish to introduce a passage in a performance on his or her piano. The human player fast moves his or her finger or fingers for the glissando. However, such a fast movement is not easy for certain human players.

In order to assist the human player with the automatic assisting system, the human player keeps a key in a unique position so as to instruct the glissando to the automatic assisting system. However, most of the human players are usually not familiar with such a peculiar fingering. Moreover, the automatic assisting system moves the keys as being described in the music data codes. The automatic assisting system moves the keys at the velocity and time intervals expressed by the music data codes regardless of the tempo at which the human player performs the music tune. As a result, the audience feels the glissando improper to the performance. Even if the human player thinks it better to play a part of the music tune in crescendo during the automatic performance, the prior art system can not respond to player's intention in real time. The above-described problem is also encountered in the automatic accompaniment system.

Another problem inherent in the prior art automatic player musical instrument is fluctuation found in performances. As well known to persons in the art, products of a musical instrument have their own individualities. Even if a set of music data codes is given to these products of musical instrument, the individualities make the performances delicately different from one another. The difference may be eliminated from the performances by changing pieces of basic reference data stored in the automatic playing systems. However, preparation of different sorts of basic reference data makes the production cost of musical instrument increased.

SUMMARY OF THE INVENTION

It is therefore an important object of the present invention to provide a keyboard musical instrument, a supporting system of which can make it possible properly to change performance on a part of a music tune from that expressed by music data in real time.

It is another important object of the present invention to provide a keyboard musical instrument, an automatic regulation system of which makes the fluctuation from performances on the keyboard musical instrument.

In accordance with one aspect of the present invention, there is provided a keyboard musical instrument used for a performance of a music tune, and the keyboard musical instrument comprises a keyboard including plural keys independently moved by a human player and used for specifying tones to be produced, a tone generating system connected to the plural keys and generating the tones specified through the moved keys, a key driving system provided for the plural keys and selectively driving the plural keys without manipulation on the plural keys carried out by the human player on the basis of target key motion vectors expressing target movements of the keys to be moved for performing a part of the music tune, a key motion reporter monitoring the plural keys and producing performance parameters expressing actual movements of the keys moved by the key driving system and the human player, a key motion controller connected to the key driving system and the key motion reporter and determining the target driving vectors for the keys to be moved on the basis of scheduled displacement vectors each expressing a displacement from the movement of the key previously moved by the key driving system or the human player to the movement of one of the keys to be moved and detected key motion vectors produced from the performance parameters and expressing the actual movements and a performance rule changer connected to the key motion controller and changing the scheduled key motion vectors for the keys to be moved on the basis of difference between the target driving vectors expressing the target movements of the keys moved by the key driving system and the human player and the detected key motion vectors expressing the actual movements of the keys moved by the key driving system and the human player.

In accordance with another aspect of the present invention, there is provided a keyboard musical instrument used for an automatic performance, and the keyboard musical instrument comprises a keyboard including plural keys independently moved for specifying tones to be produced, a tone generating system connected to the plural keys and generating the tones specified through the moved keys, a key driving system provided for the plural keys and selectively driving the plural keys without manipulation of a human player on the plural keys on the basis of target key motion vectors expressing target movements of the keys to be moved for performing the music tune, the keys moved by the key driving system taking non-uniform motion, a key motion reporter monitoring the plural keys and producing performance parameters expressing actual movements of the keys moved by the key driving system, a key motion controller connected to the key driving system and the key motion reporter and determining the target driving vectors for the keys to be moved on the basis of scheduled displacement vectors each expressing a displacement from the movement of the key previously moved by the key driving system to the movement of one of the keys to be moved and difference between the target driving vectors and detected key motion vectors produced from the performance parameters and expressing the actual movements and a performance rule changer connected to the key motion controller and changing the scheduled key motion vectors for the keys to be moved on the basis of the scheduled key motion vectors for the keys already moved and the difference between the target driving vectors and the detected key motion vectors.

In accordance with yet another aspect of the present invention, there is provided a keyboard musical instrument used for a performance of a music tune, and the keyboard musical instrument comprises a keyboard including plural keys independently moved and used for specifying tones to be produced, a tone generating system connected to the plural keys and generating the tones specified through the moved keys, a key driving system provided for the plural keys and selectively driving the plural keys without a manipulation on the plural keys by a human player on the basis of target key motion vectors expressing target movements of the keys to be moved for performing a part of the music tune, a key motion reporter monitoring the plural keys and producing performance parameters expressing actual movements of the keys moved by the key driving system and the human player, a key motion controller connected to the key driving system and the key motion reporter and determining the target driving vectors for the keys to be moved on the basis of scheduled displacement vectors each expressing a displacement from the movement of the key previously moved by the key driving system or the human player to the movement of one of the keys to be moved and the target driving vectors for the keys driven by the key driving system or the human player and a performance rule changer connected to the key motion controller and changing the scheduled key motion vectors for the keys to be moved on the basis of difference between the target driving vectors expressing the target movements of the keys moved by the key driving system and the human player and the detected key motion vectors expressing the actual movements of the keys moved by the key driving system and the human player.

In accordance with still another aspect of the present invention, there is provided a keyboard musical instrument used for a performance of a music tune, and the keyboard musical instrument comprises a keyboard including plural keys independently moved and used for specifying tones to be produced, a tone generating system connected to the plural keys and generating the tones specified through the moved keys, a key driving system provided for the plural keys and selectively driving the plural keys without a manipulation on the plural keys carried out by a human player on the basis of target key motion vectors expressing target movements of the keys to be moved for performing a part of the music tune, a key motion reporter monitoring the plural keys and producing performance parameters expressing actual movements of the keys moved by the key driving system and the human player, a key motion controller connected to the key driving system and the key motion reporter and determining the target driving vectors for the keys to be moved on the basis of scheduled displacement vectors each expressing a displacement from the movement of the key previously moved by the key driving system or the human player to the movement of one of the keys to be moved and detected key motion vectors produced from the performance parameters and expressing the actual movements and an additional key motion determiner connected to the key motion controller and instructing the key driving system to drive the keys expressed in difference between the target driving vectors expressing the target movements of the keys moved by the key driving system and the human player and the detected key motion vectors expressing the actual movements of the keys moved by the key driving system and the human player.

BRIEF DESCRIPTION OF THE DRAWINGS

The features and advantages of the keyboard musical instrument will be more clearly understood from the following description taken in conjunction with the accompanying drawings, in which FIG. 8 is a view showing data tables accessed in the automatic accompaniment, FIG. 11 is a view showing data tables accessed in the automatic accompaniment, FIG. 14 is a view showing data tables accessed in the automatic accompaniment.

DESCRIPTION OF THE PREFERRED EMBODIMENTS

In the following description, term "front" is indicative of a position closer to a human player, who sits on a stool for fingering, than a position modified with term "rear". A line drawn between a front position and a corresponding rear position extends in "fore-and-aft direction", and "lateral direction" crosses the fore-and-aft direction at right angle. "Upand-down direction" is normal with a plane defined by the fore-and-aft direction and lateral direction.

First Embodiment

Figure 1:
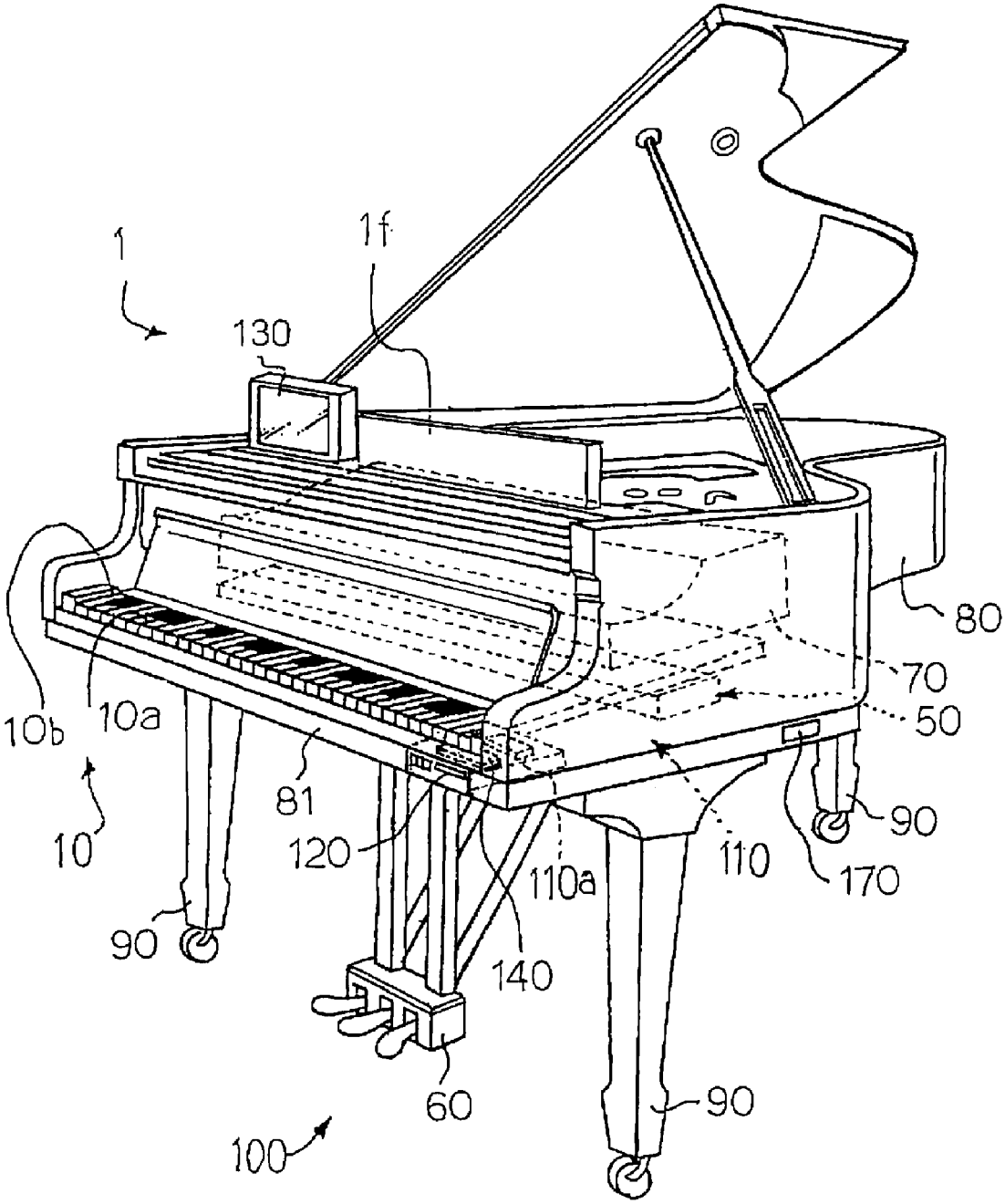
FIG. 1 is a perspective view showing the external appearance of an automatic player piano of the present invention.

Referring first to FIG. 1 of the drawings, an automatic player piano 1 embodying the present invention largely comprises an acoustic piano 100 and an automatic playing system 110. In this instance, a grand piano serves as the acoustic piano 100. However, an upright piano is available for the automatic player piano of the present invention. A human player fingers pieces of music on the acoustic piano 100 as similar to standard grand piano, and acoustic piano tones are generated in the acoustic piano 100.

Figure 2:
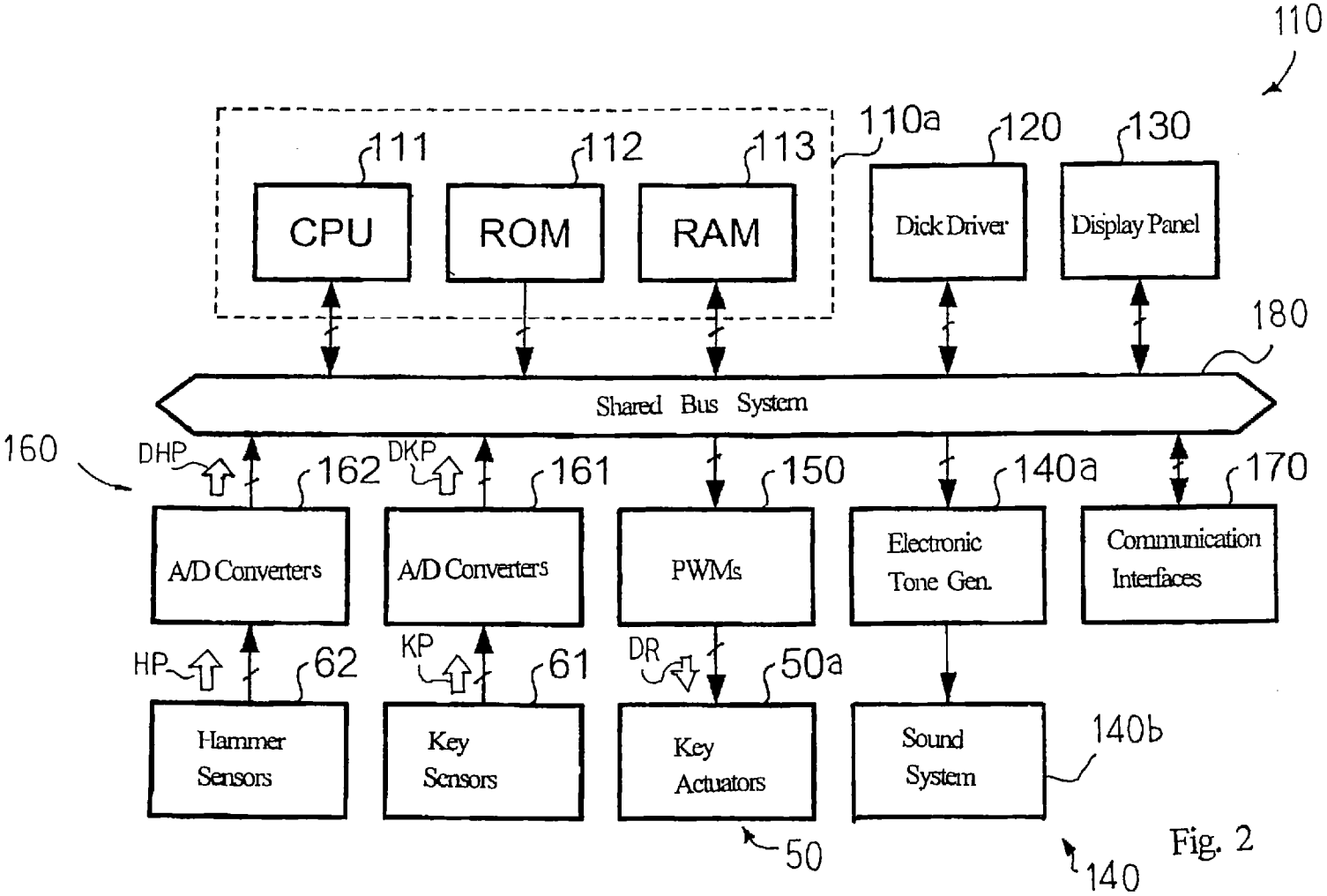
FIG. 2 is a block diagram showing the system configuration of an automatic playing system incorporated in the automatic player piano.

The automatic playing system 110 is installed inside of the acoustic piano 100, and has an information processing capability, which is realized through a computer program running on an information processing unit 110*a* shown in FIG. 2.

The automatic playing system 110 gives automatic performance support to a human player in playing passages such as, for example, glissando on the acoustic piano 100. When a user instructs an automatic performance with the assistance of the automatic performance support to the automatic playing system 100, the automatic playing system 110 sequentially processes pieces of key control data so as to produce acoustic piano tones through the acoustic piano 100 without any fingering of a human player. While the automatic playing system 110 is controlling the acoustic piano 100 on the basis of the pieces of key control data, the human player is assumed to depress a key, which is different from the key scheduled by the piece of key control data to be processed next. The automatic playing system 110 notices the human player depressing the key different from the scheduled key. Then, the automatic playing system 110 starts to play a passage instead of the part of music tune. Thus, the automatic playing system 110 gives the automatic performance support to the human player, and makes it possible easily to insert the passage into the automatic performance.

Although the above description is made on the change of playing technique such as the playing technique for the passage, the automatic performance support is given to the human player in change of loudness such as, for example, crescendo or decrescendo and in change of tempo such as, for example, ritardando by preparing suitable rules of change.

Acoustic Piano

Turning back to FIG. 1, the acoustic piano 100 includes a keyboard 10, a mechanical tone generator 70, a piano cabinet 80 and legs 90. The legs 90 downwardly project from a flat portion of the piano cabinet 80 which is called as a key bed 81, and keep the piano cabinet 80 over a floor. The keyboard 10 is mounted on the key bed 81, and white keys 10*a* and black keys 10*b* are laterally arranged in a well known pattern in the keyboard 10. The front portions of white keys 10*a* and the front portions of black keys 10*b* are exposed to a human player who sits on a stool in front of the keyboard 10, and are movable in the up-and-down direction. Notes of a scale are respectively assigned to the white keys 10*a* and black keys 10*b*, and a human player specifies the pitch of acoustic piano tones by means of the white keys 10*a* and black keys 10*b*. The total number of the white keys 10*a* and black keys 10*b* is eighty-eight, and a key number is assigned to each of the white keys 10*a* and black keys 10*b* so that any one of the white keys 10*a* and black keys 10*b* is specified by using the key number. In this instance, the key number is varied from 1 to 88.

An inner space is defined in the piano cabinet 80, and the mechanical tone generator 70 is accommodated in the inner space of the piano cabinet 80. The rear portions of white keys 10*a* and the rear portions of black keys 10*b* are connected in parallel to the mechanical tone generator 70, and the movements of white keys 10*a* and the movements of black keys 10*b* make the mechanical tone generator 70 actuated for generating the acoustic piano tones at the pitch specified through the white keys 10*a* and black keys 10*b*.

Figure 3:
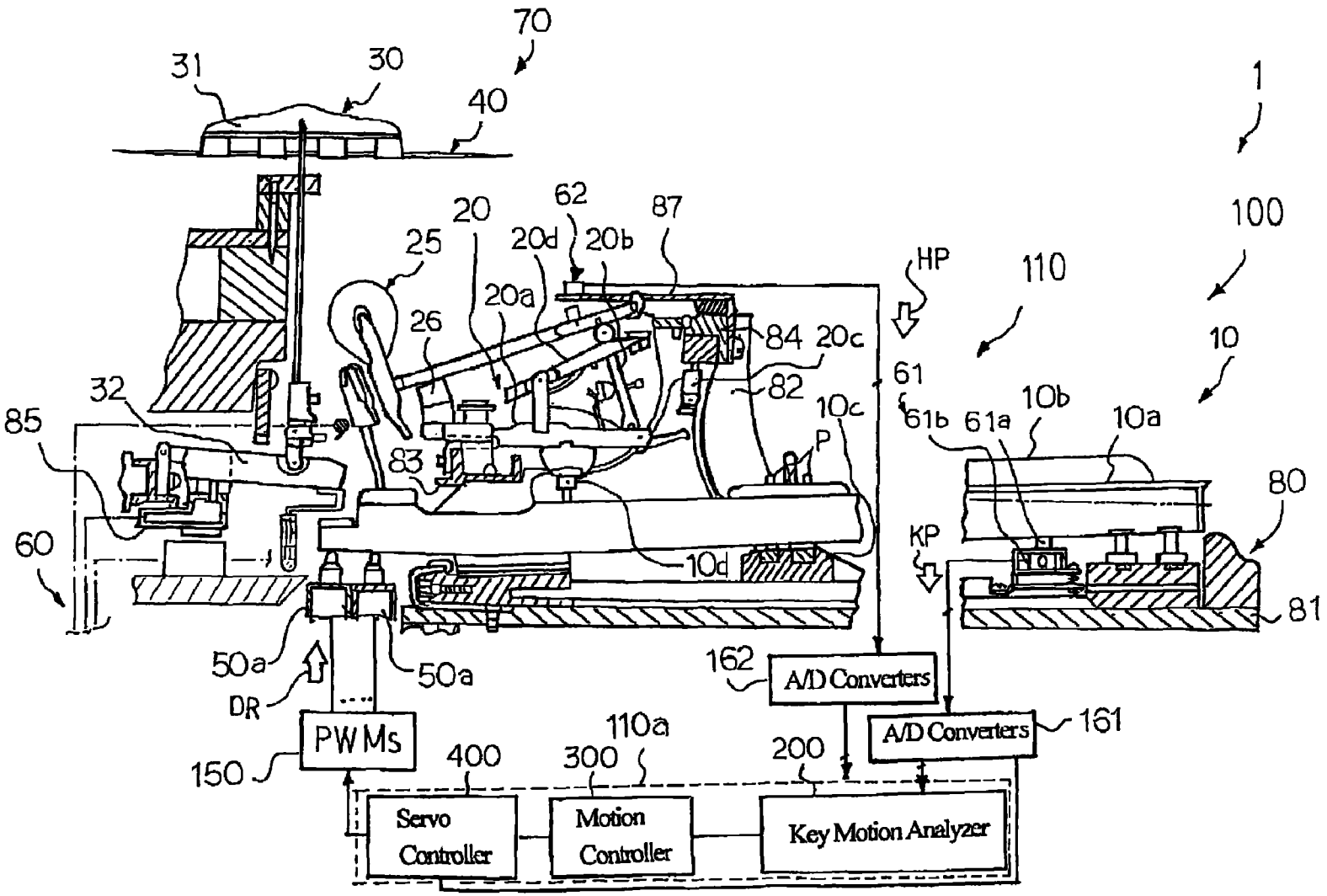
FIG. 3 is a cross sectional side view showing the structure of an acoustic piano forming a part of the automatic player piano.

Turning to FIG. 3 of the drawings, a balance rail 10*c* extends on the key bed 81 in the lateral direction, and the white keys 10*a* and black keys 10*b* are put on the balance rail 10*c* at intermediate portions thereof. Balance key pins P upwardly project from the balance rail 10*c*, and offer the fulcrums to the white keys 10*a* and black keys 10*b*. Capstan screws 10*d* upwardly projects from the rear portions of white keys 10*a* and the rear portions of black keys 10*b*, and the white keys 10*a* and black keys 10*b* are connected to the mechanical tone generator 70 through the capstan screws 10*d*. The mechanical tone generator 70 exerts the weight thereof on the capstan screws 10*d* so that the rear portions of white keys 10*a* and the rear portions of black keys 10*b* are pressed down. While any force is not exerted on the front portions of white keys 10*a* and the front portions of black keys 10*b* in the downward direction, the front portions of white keys 10*a* and the front portions of black keys 10*b* are spaced from the key bed 81 as shown by real lines in FIG. 3, and the white keys 10*a* and black keys 10*b* stay at "rest positions".

On the other hand, when force, which becomes larger than the weight of mechanical tone generator 70 exerted on each key 10*a* or 10*b*, is exerted on the front portions of white keys 10*a* and the front portions of black keys 10*b*, the front portions of white keys 10*a* and the front portions of black keys

10*b* start to travel in the downward direction, and the rear portions of white keys 10*a* and the rear portions of black keys 10*b* starts to travel in the upward direction. When the front portions of white keys 10*a* and the front portions of black keys 10*b* reach the lower dead points, the white keys 10*a* and black keys 10*b* enter "end positions." On the other hand, when the force is removed from the white keys 10*a* and black keys 10*b*, the front portions of white keys 10*a* and the front portions of black keys 10*b* are moved to the upper dead points, and the white keys 10*a* and black keys 10*b* return to "rest positions".

In the following description, term "depressed key" means the white key 10*a* moved toward the end position or the black key 10*b* moved toward the end position, and term "released key" means the white key 10*a* moved toward the rest position or the black key 10*b* moved toward the rest position.

The mechanical tone generator 70 includes action units 20, hammers 25, dampers 30, strings 40 and a pedal mechanism 60. Each of the white keys 10*a* and black keys 10*b* is connected to one of the action units 20 and one of the dampers 30, and each of the action units is linked with one of the hammers 25. Each of the hammers 25 is opposed to one of the strings 40, and each of the dampers 25 is provided for one of the strings 40. When a human player depresses and releases one of the white keys 10*a* and black keys 10*b*, the depressed key 10*a* or 10*b* and the released key 10*a* or 10*b* give rise to movements of the associated action unit 20, movements of associated damper 30 and movements of associated hammer 25, and the acoustic piano tone is generated through the vibrations of associated string 40. The pedal mechanism 60 is connected to the keyboard 10 and dampers 30, and is actuated for imparting pedal effects to the acoustic piano tones.

Action brackets 82 are put on the key bed 81, and are spaced from one another in the lateral direction. The action brackets 82 project over the array of white keys 10*a* and black keys 10*b*. A whippen rail 83 extends over the rear portions of white keys 10*a* and the rear portions of black keys 10*b*, and is supported by the rear portions of action brackets 82. A hammer shank flange 84 extends in the space between the whippen rail 83 and the center rail 10*c* in the lateral direction, and is supported by the front portions of action brackets 82.

The action units 20 are rotatably supported by the whippen rail 83 so as to be provided over the rear portions of white keys 10*a* and the rear portions of black keys 10*b*. Each of the action units 20 has a whippen assembly 20*a*, a jack mechanism 20*b*, a regulating button mechanism 20*c* and a repetition mechanism 20*d*. The whippen assembly 20*a* is rotatably connected at the rear end portion thereof to the whippen rail 83 and at the lower portion thereof to the capstan screw 10*d* of the associated key 10*a* or 10*b*. While the associated key 10*a* or 10*b* is traveling toward the end position, the capstan screw 10*d* pushes the whippen assembly 20*a* in the upward direction, and the whippen assembly 20*a* is rotated about the whippen rail 83 in the counter clockwise direction in FIG. 3. On the other hand, when the associated key 10*a* or 10*b* starts to travel toward the rest position, the capstan screw 10*d* is moved in the downward direction, and permits the whippen assembly 20*a* to rotate about the whippen rail 83 in the opposite direction, i.e., the clockwise direction. The repetition mechanism 20*d* is rotatably connected to the upper end portion of whippen assembly 20*a*.

The jack mechanism 20*b* is rotatably connected to the front portion of the whippen assembly 20*a*, and the regulating button mechanism 20*c* is supported by the action brackets 82 through the hammer flange rail 84. A regulating button of the associated regulating button mechanism 20*c* downwardly projects from a regulating rail, which is shared among the regulating mechanisms, and is opposed to a toe of the associated jack 20*b*. While the whippen assembly 20*a* is rotating in the counter clockwise direction, the toe is getting closer and closer to the regulating button. When the toe is brought into contact with the regulating button, the jack is rotated about the front portion of whippen assembly 20*a* in the clockwise direction.

The damper 30 is provided at the back of the associated white key 10*a* or associated black key 10*b*, and is rotatably connected to a damper lever rail 85, which extends in the lateral direction so as to be shared with the other dampers 30. The damper 30 projects in the upward direction, and has a damper head 31 and a damper lever 32. While the associated white key 10*a* or associated black key 10*b* is staying at the rest position, the damper lever 32 is spaced from the rear portion of associated white key 10*a* or the rear portion of associated black key 10*b*. The gravity pulls the damper 30 in the downward direction, and the damper head 31 is held in contact with the associated string 40. Thus, the damper 30 is rest at the original position, and the damper head 31 prevents the associated string 40 from vibrations and resonance.

When the front portion of associated white key 10*a* or the front portion of associated black key 10*b* is depressed, the associated white key 10*a* or associated black key 10*b* starts to travel toward the end position, and the rear portion is moved in the upward direction. The upper surfaced of rear potion is brought into contact with the damper lever 32, and gives rise to rotation of damper lever 32 in the counter clockwise direction. The damper head 31 is pushed in the upward direction, and is spaced from the associated string 40. Then, the string 40 gets ready to vibrate.

The notes of scale are respectively assigned to the strings 40, and each of the strings 40 is designed to vibrate at a value of frequency equal to the pitch of the assigned note. Most of the strings 40 each have sets of three wires.

The hammer 25 is rotatably connected to the hammer shank flange 84 over a repetition lever of the repetition mechanism 20*d*, and the associated string 40 is stretched over the hammer 25. While the associated white key 10*a* or associated black key 10*b* is staying at the rest position, the whippen assembly 20*a*, jack mechanism 20*b* and repetition mechanism 20*d* take their original positions, respectively, and the hammer 25 is rest on the upper surface of jack mechanism 20*b* as shown in FIG. 3.

While the associated white key 10*a* or associated black key 10*b* is traveling from the rest position to the end position, the toe of jack mechanism 20*b* is getting closer and closer to the regulating button in the rotation of whippen assembly 20*a*, and the jack mechanism 20*b* forces the hammer 25 to rotate in the clockwise direction. When the toe is brought into contact with the regulating button, the jack mechanism 20*b* is quickly rotated in the clockwise direction, and kicks the associated hammer 25. Then, the hammer 25 escapes from the jack mechanism 20*b*, and starts free rotation toward the associated string 40. The hammer 25 is brought into collision with the associated string 40, and gives rise to vibrations of the associated string 40. The hammer 25 rebounds on the string 40. The hammer 25 is received on a hammer shank stop felt 26 of the associated whippen assembly 20*a*, and the repetition mechanism 20*d* makes the hammer 25 get ready to escape from the jack mechanism 20*b*.

The pedal mechanism 60 has three pedal sub-mechanisms. One of the three pedal sub-mechanisms is connected to the keyboard 10, and makes the acoustic piano tones lessened in loudness through a lateral movement of the keyboard 10. The other pedal sub-mechanisms are connected to the dampers 30, and make the acoustic piano tones prolonged through interruption of the downward movements of dampers 30.

Automatic Playing System

Turning back to FIG. 1 of the drawings, the automatic playing system 110 includes the information processing unit 110*a*, a disk driver 120, a panel display 130, an electronic tone generating system 140, a sensor system 160 (see FIG. 2), a communication interface 170 and a key driver system 50, and the information processing unit 110*a* is electrically connected to the disk driver 120, panel display 130, electronic tone generating system 140, sensor system 160, communication interface 170 and key driver system 50.

Users communicate with the information processing unit 110*a* through the display panel 130. The information processing unit 110*a* periodically fetches pieces of actual performance data from the sensor system 160 for the automatic performance support, and reads out the pieces of key control data so as to control the key driver system 50 for the automatic performance support as well as automatic performance. Pieces of music data are coded in accordance with the MIDI protocols, and sets of music data codes and sets of the pieces of key control data are stored in the disk driver 120. The pieces of key control data are coded as key control data codes, and will be hereinlater described in detail.

The duration data codes and key event data codes form parts of a set of music data codes as described hereinbefore. The key event data code expressing the generation of tone is called as a note-on event data code, and the key event data code expressing the decay of the tone is called as a note-off event data code. The tone to be generated and the tone to be decayed are specified by using the key number so that a key code, which expresses the key number, is incorporated in the note-on event data code and note-off event data code.

The music data codes may be transferred from the information processing unit 110*a* to the electronic tone generating system 140. In this situation, the electronic tones are generated on the basis of the music data codes through the electronic tone generating system 140. A wireless channel and a wire channel are established between the communication interface 170 and another electronic appliance, and the computer program, pieces of music data and/or pieces of key control data may be downloaded from a suitable data source through the communication interface 170 to the automatic playing system 110.

As shown in FIG. 2, the information processing unit 110*a* is connected to a shared bus system 180, which is further connected to the sensor system 160, electronic tone generating system 140 and communication interface 170 and key driver system 50. Therefore, the information processing unit 110*a* sends pieces of data to and receives them from the sensor system 160, key drive system 50, disk driver 120, display panel 130, electronic sound generating system 140 and communication interfaces 170 through the shared bus system 180.

The information processing unit 110*a* includes a central processing unit 111, which is abbreviated as "CPU", a read only memory 112, which is abbreviated as "ROM", a random access memory 113, which is abbreviated as "RAM" and peripheral processors (not shown). The central processing unit 111 is the origin of the data processing capability, and sequentially fetches and executes instruction codes of a computer program. While the computer program is running on the central processing unit 111 for the automatic performance support during the automatic performance, a key motion analyzer 200, a motion controller 300 and a servo controller 400 are realized as shown in FIG. 3. These software modules 200, 300 and 400 will be hereinlater described in detail.

The read only memory 112 makes pieces of data information stored therein in non-volatile manner, and includes semiconductor flash memory devices so that the pieces of data information stored therein are rewritable. Constants and control parameters, which are used in the data processing for the automatic performance support during the automatic performance, are stored in the read only memory 112. The instruction codes may be stored in the read only memory 112.

The random access memory 113 makes pieces of data information stored therein in volatile manner, and serves as a working memory for the central processing unit 111. Various data tables are defined in the random access memory 113, and predetermined memory locations are assigned to flags. One of the data tables is referred to as "a key position data table", in which the pieces of key position data are stored. Another data table is referred to as "a performance rule table", in which performance rules are stored, and yet another data table is referred to as "an initial parameter table", in which initial values of target driving vector are stored.

Still another data table is called as "a performance parameter table", in which performance parameters are stored for moved keys 10*a* and 10*b*, and yet another data table is called as "a detected key motion parameter table", in which actual key motion parameters are stored for the moved keys. Still another data table is called as "a driving parameter table", in which driving parameters of target driving vectors are stored. Yet another data table is called as "a deviation parameter table", in which deviation parameters of deviation vectors are stored.

The performance rules, target driving vector, performance parameters, detected key motion parameters, target driving vector and deviation vector will be hereinlater described in detail. Some flags are indicative of modes of operation. One of the modes is the automatic performance support during the automatic performance. Another flag is used as a stop sign, and yet another flag is used as an instruction. The stop sign and instruction will be also hereinlater described in detail.

In case where the computer program is stored in the disk driver 120, the instruction codes of computer program are transferred to the random access memory 113. The music data codes and key control data codes are transferred from the disk driver 120 to the random access memory 113 before the standard automatic performance and the automatic performance support during the automatic performance.

The disk driver 120 has a disk tray where an information storage medium such as, for example, a DVD (Digital Versatile Disk) or a CD (Compact Disk) is mounted, and pieces of data information are read out from the DVD or CD by means of a read-out head. The computer program, sets of music data codes and sets of key control data codes are stored in the disk driver 120, and are transferred to the random access memory 113. The key control data codes, which express the pieces of key control data, will be hereinlater described in detail.

The display panel 130 is implemented by an image producing panel such as, for example, a liquid crystal display panel and a touch-screen, and an image-producing screen of the image producing panel is overlapped with the touch-screen. Visual images are produced on the image-producing screen under the control of the information processing unit 110*a*, and a job menu, a list of music tunes, music scores, prompt messages and indicators are, by way of example, expressed by the visual images. Users give their instructions, options and intentions to the information processing unit 110*a* by pressing areas of touch-screen over the visual images with their fingers. The information processing unit 110*a* determines what visual image is pressed, and responds to user's instruction, option and intention depending upon the depressed visual image. Thus, the display panel 130 serves as a man-machine interface.

The automatic performance support during automatic performance is one of the jobs in the job list so that the users instruct the automatic performance support through the display panel 130. The automatic performance support is required in collaboration between a human pianist and the automatic playing system 110, and the collaboration is carried out in a certain mode called as "a passage performance mode." Term "passages" was hereinbefore described in conjunction with the related prior arts, and glissando is an example of the passages.

The electronic tone generating system 140 includes an electronic tone generator 140*a* and a sound system 140*b*. The electronic tone generator 140*a* has a waveform memory where pieces of waveform data are stored. When the note-on event data code reaches the electronic tone generator 140*a*, a tone generation channel is assigned to the note-on event data code, and the pieces of waveform data expressing a waveform of an electronic tone to be generated are successively read out from the waveform memory, and an audio signal is produced from the pieces of waveform data. On the other hand, when the note-off event data code is transferred from the information processing unit 110*a* to the electronic tone generator 140*a*, the read-out operation is stopped, and the audio data signal is decayed.

The sound system 140*b* is connected to the electronic tone generator 140*a* so that the audio signal is supplied from the electronic tone generator 140*a* to the sound system 140*b*. The sound system 140*b* has amplifiers and loud speakers. The audio signal is equalized and amplified through the amplifiers, and is converted to the electronic tones through the loud speakers.

The key drive system 50 includes solenoid-operated key actuators 50*a* and plural pulse width modulators 150, which is abbreviated as "PWMs". Turning to FIG. 3, the solenoid-operated key actuators 50*a* are supported by the key bed 81 through a bracket (not shown), and plungers of the solenoid-operated key actuators 50*a* are exposed to the space under the rear portions of white keys 10*a* and the rear portions of black keys 10*b* through a slot formed in the key bed 81. The solenoid-operated key actuators 50*a* are respectively associated with the white keys 10*a* and black keys 10*b* so that the total number of solenoid-operated key actuators 50*a* is equal to the number of keys 10*a* and 10*b*, i.e., eighty-eight. A predetermined number of solenoid-operated key actuators 50*a* are connected to one of the pulse width modulators 150, and a driving pulse signal DR is supplied from the pulse width modulator 150 to the solenoid-operated key actuators 50*a* to be driven. The driving pulse signal DR is varied in duty ratio depending upon the amount of electromagnetic force to be required for the target key movements. In this instance, the driving pulse signal DR is a pulse train, and the number of pulses per unit time is varied so as to change the duty ratio.

While the driving pulse signal DR is flowing through the solenoid-operated key actuator 50*a*, the electromagnetic field is created around the plunger of solenoid-operated key actuator 50*a*, and the electromagnetic force is exerted on the plunger in the upward direction. The plunger projects in the upward direction, and pushes the rear portion of associated white key 10*a* or the rear portion of associated black key 10*b*. The white key 10*a* or black key 10*b* travels toward the end position. When the driving pulse signal DR is removed from the solenoid-operated key actuator 50*a*, the electromagnetic is exerted no longer. The plunger is retracted in the downward direction, and the white key 10*a* or black key 10*b* returns to the rest position.

The sensor system 160 includes key sensors 61, analog-to-digital converters 161, hammer sensors 62 and analog-to-digital converters 162. The analog-to-digital converters 161 and 162 are connected in parallel to the shared bus system 180, and the key sensors 61 and hammer sensors 62 are respectively connected to the analog-to-digital converters 161 and analog-to-digital converters 162. The key sensors 61 are equal in number to the white keys 10*a* and black keys 10*b*, and are provided under the front portions of keys 10*a* and 10*b*, respectively. Therefore, eighty-eight key sensors 61 form an array for the white keys 10*a* and black keys 10*b*. The hammer sensors 62 are also equal in number to the hammers 25, and are supported over the hammers 62 by a bracket 87. Thus, eighty-eight hammer sensors 62 are arrayed over the hammers 25.

In this instance, the key sensors 61 are implemented by optical position transducers. As shown in FIG. 3, shutter plates 61*a* and optical sensor heads 61*b* form the array of key sensors 61 together with light emitting elements, light detecting elements and optical fibers (not shown).

The shutter plate 61*a* is secured to the lower surface of the front portion of white key 10*a* or the lower surface of the front portion of black key 10*b*, and is moved along a shutter trajectory together with the white key 10*a* or black key 10*b*. The optical sensor heads 61*b* are mounted on the key bed 81, and are spaced from one another. The light emitting elements are selectively connected through the optical fibers to every other optical sensor head 61*b*, and the light detecting elements are selectively connected through the other optical fibers to the remaining optical sensor heads 61*b*. Each of the optical sensor heads 61*b* connected to one of the light emitting elements is paired with and opposed to one of the optical sensor heads 61*b* connected to one of the light detecting elements. Each pair of optical sensor heads 61*b* is associated with one of the white keys 10*a* or one of the black keys 10*b*, and the optical sensor heads 61*b* of the pair are provided on both sides of a trajectory of the shutter plate 61*a*.

The pairs of optical sensor heads are divided into plural groups. The optical sensor heads of the pairs forming each group are connected to one of the light emitting elements, and the other optical sensor heads of each group are connected to the light detecting elements, respectively. The light emitting elements are sequentially energized, and the light is propagated through the optical fibers to the associated optical sensor heads. Light beams are respectively radiated from the optical sensor heads across the trajectories of shutter plates 61*a*, and are incident on the optical sensor heads paired with the light radiating sensor heads. The incident light is propagated from the optical sensor heads through the optical fibers to the light detecting elements, and is converted to photo current. One of the light emitting elements is assumed to be energized. The light beams radiated from the optical sensor heads of the associated group toward the optical sensor heads paired with the light emitting optical sensor heads, and the incident light is propagated from the light receiving optical sensor heads to the different light detecting elements so as to be converted to the photo current.

If the white keys 10*a* and black keys 10*b* are staying at the rest positions, the radiated light reaches the light detecting elements without any substantial loss. If the white keys 10*a* and black keys 10*b* are found on the way toward the end position, the attached shutter plates 61*a* interrupt the radiated light, and part of the radiated light reaches the light detecting elements. The amount of photo current is varied depending upon the current positions of the shutter plates 61*a*, i.e., the current key positions. The photo current is converted to the potential level of key position signals KP through suitable current-to-voltage converters, and the key position signals KP are supplied to the analog-to-digital converters 161. The key position signals KP are periodically sampled, and the discrete values of key position signals KP are stored in digital key position signals DKP. Thus, the array of optical sensor heads is sequentially scanned with the light for determining the current key positions.

In this instance, the end positions are spaced from the rest positions along the key trajectories by 10 millimeters, and, the light beams are wide enough to detect the current key positions on the key trajectories between the rest positions and the end positions.

The hammer sensors 62 are implemented by a sort of optical position transducers. The hammer sensors 62 are provided in association with the hammers 25, respectively, and produces hammer position signals HP. The hammer position signals HP are indicative of hammer positions in the vicinity of the rebounding points and impact timing or timing at which the hammers 25 are brought into collision with the associated strings 40. The hammer position signals HP are supplied from the hammer sensors 62 to the analog-to-digital converters 162, and the discrete levels of hammer position signals HP are stored in digital hammer position signals DHP.

The central processing unit 111 periodically fetches the digital hammer position signals DHP, and values of hammer positions are stored in one of the tables, i.e., a hammer table defined in the random access memory 113. The central processing unit 111 calculates a final hammer velocity, which is corresponding to the velocity in the MIDI protocols, on the basis of variation of values of the hammer positions, and determines impact timing, i.e., timing at which the hammers 25 are brought into collision with the strings 40 with the assistance of the internal software clock. The MIDI music data codes are produced on the basis of the final hammer velocity, impact timing and other pieces of performance data.

Key Control Data, Performance Parameters and Driving Parameters

The pieces of key control data are hereinafter described in detail. The pieces of key control data express scheduled key motion parameters of scheduled displacement vectors, which form a performance rule, and contents of an initial parameter table for the passage performance mode. The white keys 10*a* and black keys 10*b* to be moved and scheduled key motion parameters, which are used for determining the reference key trajectories for the depressed keys 10*a*/10*b* and released keys 10*a*/10*b* are defined in the performance rule, and the scheduled key motion parameters, i.e., contents of the performance rules are determined as relative values to the contents for the previously moved key 10*a*/10*b*. The contents of the performance rules are hereinafter referred to as "details of movements". The details of movements are corresponding to performance parameters as will be described hereinafter in detail.

A set of the pieces of key control data is prepared for a piece of music expressed by a music score. In case where a melody line and an accompaniment are written in the music score, the pieces of key control data express not only the melody line but also the accompaniment.

The performance parameters are determined on the basis of the digital key position signals DKP, and express the white keys 10*a* and black keys 10*b* actually moved and actual movements of the white keys 10*a* and black keys 10*b*.

The key number is used for specifying the actually moved white keys 10*a* and actually moved black keys 10*b*. The key number is varied from "1" to "88". The values of key number from 2 to 88 are indicative of the tones higher in pitch than the tones assigned the values of key number from 1 to 87 by a semitone. In this instance, the key number of "1" is indicative of the lowest tone to be produced through the keyboard 10, and the key number of "88" is assigned to the highest tone to be produced through in the keyboard 10.

A depressed key time tp, a depressed key velocity vp, a released key time tn and a released key velocity vn are employed as the other performance parameters. The depressed key time tp is indicative of a time at which the white keys 10*a* and black keys 10*b* start to move toward the end positions, and the released key time tn is indicative of a time at which the white keys 10*a* and black keys 10*b* start to move toward the rest positions. The depressed key time tp and released key time tn are given as a lapse of time from an initiation of the passage performance, and unit is millisecond. For example, if the value of depressed key time tp is 1000, the associated white key 10*a* or associated black key 10*b* is depressed at 1000 milliseconds after the initiation of passage performance. A software clock is assigned to the lapse of time from the initiation of passage performance.

The depressed key velocity vp and released key velocity vn express the velocity of depressed keys 10*a*/10*b* and the velocity of released keys 10*a*/10*b*, and the value of depressed key velocity vp and released key velocity vn is varied from "1" to "127" like the velocity defined in the MIDI protocols. The larger the depressed key velocity vp and released key velocity vn are, the faster the white keys 10*a* and black keys 10*b* move. The depressed key velocity vp is calculated on the basis of lapse of time from the keystroke of 1 millimeter to the keystroke of 9 millimeters. On the other hand, the released key velocity vn is calculated on the basis of lapse of time from the keystroke of 9 millimeters to the keystroke of 1 millimeter.

Description is hereinafter made on the details of movement in the performance rule. The scheduled displacement vectors g[i] are stored in the performance rule table as the details of movements of performance rule, and each of the scheduled displacement vectors g[i] defines a movement of the white key 10*a* or black key 10*b* to be moved next to the currently moved key 10*a* or 10*b*. In the automatic performance, the movements of the white keys and black keys 10*a*/10*b* are sequentially defined by the scheduled displacement vectors g[i]. In other words, the scheduled displacement vectors g[i] are respectively assigned to the white keys 10*a* and black keys 10*b* on a music score. If a human player does not requests the automatic playing system 110 for the automatic performance support in the automatic performance, the automatic playing system 110 completes the automatic performance with reference to the scheduled displacement vectors g[i].

An index [i] is indicative of the position of the notes in the music score, and is successively increased from zero by one. The scheduled displacement vector g for the first key 10*a* or 10*b* in the music score is labeled with [0], and the scheduled displacement vector g for the second key 10*a* or 10*b* to be moved next to the first key 10*a* or 10*b* is labeled with [1]. The first key 10*a* or 10*b* may be same in key number as or different in key number from the second key 10*a* or 10*b*.

Each of the scheduled displacement vectors g[i] has scheduled key motion parameters, which express a displacement of key number gk[i], a displacement of depressed key time gtp [i], a displacement of depressed key velocity gvp[i], a displacement of released key time gtp[i] and a displacement of released key velocity gvn[i], respectively. Thus, the scheduled key motion parameters are corresponding to the performance parameters, respectively.

The first scheduled key motion parameter gk[i], i.e., the displacement of key number is indicative of the increment or decrement of key number k from the currently moved key 10*a* or 10*b* to the next moved key 10*a* or 10*b*, and is fallen within the range between −87 and +87. The second scheduled key motion parameter gtp[i], i.e., the displacement of depressed key time is indicative of the increment or decrement of depressed key time tp from the currently moved key 10*a* or 10*b* to the next moved key 10*a* or 10*b*, and is defined in millisecond. The third scheduled key motion parameter, i.e., the displacement of depressed key velocity gvp[i] is indicative of the increment or decrement of depressed key velocity vp from the currently moved key 10*a* or 10*b* to the next moved key 10*a* or 10*b*, and is fallen within the range between −126 and +126.

The fourth scheduled key motion parameter gtn[i], i.e., the displacement of released key time is indicative of the increment or decrement of released key time to from the currently moved key 10*a* or 10*b* to the next moved key 10*a* or lob, and is defined in millisecond. The fifth parameter gvn[i], i.e., the displacement of released key velocity is indicative of the increment or decrement of released key velocity vn from the currently moved key 10*a* or 10*b* to the next moved key 10*a* or 10*b*, and is fallen within the range between −126 and +126.

The scheduled displacement vectors g[i] are able to be subjected to change due to the passage intended by the human player, and the scheduled key motion parameter or parameters are successively varied in the order of the index [i] for the intended passage.

Initial values r[0] of the target driving vectors r[i] are stored in the initial driving parameter table, and the other values of target driving vectors r[i] are determined through calculations as will be described hereinlater.

The target driving vectors r[i] express driving parameters corresponding to the performance parameters and scheduled key motion parameters, and movements of the plungers of solenoid-operated key actuators 50*a* are defined by using the target driving vectors r[i]. The driving parameters express a target key number rk[i], a target depressed key time rtp[i], a target depressed key velocity rvp[i], a target released key time rtn[i] and a target released key velocity rvn[i]. [i] is the index.

The reference key trajectory, i.e., a reference forward key trajectory toward the end position and a reference backward key trajectory toward the rest position are prepared on the basis of the driving parameters rtp[i], rvp[i], rtn[i] and rvn[i]. In this instance, the depressed keys and released keys 10*a* and 10*b* are assumed to take uniform motion along the reference key trajectory.

The target key number rk[i] is fallen within the range between 1 and 88, and the unit of target depressed key time rtp[i] and the unit of target released key time rtn[i] are millisecond. The target depressed key velocity rvp[i] and target released key velocity rvn[i] are fallen within the range between 1 and 127. The values of those driving parameters rk[0], rtp[0], rvp[0], rtn[0] and rvn[0] are stored in the initial parameter table defined in the random access memory 113.

Software Modules

The computer program is broken down into a main routine program and subroutine programs. The main routine program conditionally branches to the subroutine programs. When a user turns on a power supply switch of the automatic playing system 110, the central processing unit 111 starts to execute the instruction codes of the main routine program. The automatic playing system 110 is firstly initialized in the execution of the instruction codes of main routine program.

One of the subroutine programs is assigned to the passage performance mode, i.e., the automatic performance with the assistance of the automatic performance support, and another subroutine program is assigned to the software clocks for measuring lapses of time. Yet another subroutine program is assigned to data gathering. While the subroutine program for the passage performance mode is running on the central processing unit 111, the central processing unit 111 periodically checks the software clock to see whether or not a predetermine time period is expired. While the answer is given negative, the central processing unit 111 returns to the subroutine program for the passage performance mode. On the other hand, when the predetermined time period is expired, the answer is given affirmative, and the central processing unit 111 fetches the digital key position signals DKP from the analog-to-digital converters 161 so as to store the values of digital key position signals DKP in the key position data table created in the random access memory 113. In the key position data table, eighty-eight queues are stored, and are assigned to the eighty-eight keys 10*a* and 10*b*, respectively. A predetermined number of values form each of the eighty-eight queues. When new values reach the key position data table, the new values are put at the last positions of the associated queues, and the oldest values are pushed out from the queues.

Still another subroutine program is assigned to a standard automatic performance, i.e., the automatic performance without any assistance of the automatic performance support. The standard automatic performance is carried out on the basis of a set of the music data codes expressing the notes of a music tune to be produced in the automatic performance, and the white keys 10*a* and black keys 10*b* are sequentially moved by means of the solenoid-operated key actuators 50*a* under the control of the automatic playing system 110. The set of music data codes are prepared in accordance with the MIDI protocols. When a user selects the standard automatic performance from the job list, the central processing unit 111 raises the flag indicative of the standard automatic performance, and the main routine program starts periodically to branch to the subroutine program for the standard automatic performance. While the subroutine program for the standard automatic performance is running on the central processing unit 111, the reference key trajectories are determined for the white keys 10*a* and black keys 10*b* to be moved, and the automatic playing system 110 forces the white keys 10*a* and black keys 10*b* to travel on the reference key trajectories by means of the solenoid-operated key actuators 50*a*. Thus, the white keys 10*a* and black keys 10*b* are sequentially moved for reenacting an original performance without any fingering of a human player.

While the main routine program is running on the central processing unit 111, users communicate with the information processing unit 110*a*. The visual images of job menu are assumed to be produced on the display panel 130. If a user presses the visual image of "passage performance mode" with his or her finger, the central processing unit 111 decides that the user instructs the passage performance mode to the information processing unit 110*a*, and raises the flag indicative of the passage performance mode. The central processing unit 111 produces the visual images of a list of music tunes, the sets of key control data codes of which are presently available for the passage performance mode, on the display panel 130, and waits for user's selection. When the user selects one of the music tunes, the main routine program starts periodically to branch to the subroutine program for the passage performance mode.

Although the following job sequence of the subroutine program for the passage performance mode is carried out for each of the depressed keys 10*a* and 10*b* and each of the released keys 10*a* and 10*b*, the job sequence is described as if only one of the white keys 10*a* and black keys 10*b* is depressed and released for better understanding. In case where more than one key 10*a* and 10*b* is concurrently depressed and released, the jobs are carried out in parallel for the more than one key 10*a* and 10*b*.

While the subroutine program for the passage performance mode is running on the central processing unit 111, software modules 200, 300 and 400 are realized as shown in FIG. 3. These software modules 200, 300 and 400 are hereinafter referred to as "key motion analyzer", "motion controller" and "servo controller". The key motion analyzer 200, motion controller 300 and servo controller 400 are hereinafter described in detail.

When a user selects the standard automatic performance, the white keys 10*a* and black keys 10*b* are forced to travel on the reference forward key trajectories and reference backward key trajectories by means of the motion controller 300 and servo controller 400. In the standard automatic performance, the motion controller 300 prepares a series of values of a target key position, i.e., the reference key trajectory on the basis of the music data code expressing the note-on key event, and the values are periodically supplied from the motion controller 300 to the servo controller 400. The servo controller 400 compares the value of target key position and a value of target key velocity with a value of actual key position and a value of actual key velocity to determine whether or not a positional difference and/or a velocity difference is found. If the positional difference and/or velocity difference occurs, the servo controller 400 regulates the duty ratio of driving signal DR to a new value so as to force the white key 10*a* or black key 10*b* to travel on the reference key trajectory.

Description returns to the passage performance mode. The central processing unit 111 periodically checks the key position data table to see whether or not the pieces of key position data in any one of the queues is indicative of the movement of associated white key 10*a* or the movement of associated black key 10*b*. While the latest pieces of key position data are equal in value to the previous pieces of key position data, the white keys 10*a* and black keys 10*b* stay at the previous key positions, and the answer is given affirmative. Then, the central processing unit 111 proceeds to the next job.

On the other hand, when the central processing unit 111 finds a depressed key 10*a* or 10*b*, the central processing unit 111 determines the key number k assigned to the depressed key 10*a* or 10*b* and the depressed key time tp. The central processing unit 111 stores the key number k and depressed key time tp in the random access memory 113 for the depressed key 10*a* or 10*b*.

Subsequently, the central processing unit 111 periodically checks the key position data table to see whether or not the depressed key 10*a* or 10*b* reaches a predetermined key stroke. While the depressed key 10*a* or 10*b* is traveling on the way to the predetermined key stroke, the answer is given negative, and the central processing unit 111 stands idle for the depressed key 10*a* or 10*b*.

On the other hand, when the depressed key 10*a* or 10*b* reaches the predetermined key stroke, the central processing unit 111 reads a time at which the depressed key 10*a* or 10*b* reaches the predetermined key stroke from the software clock, and calculates time difference between the read-out time and the depressed key time tp. Since the time difference is proportional to the depressed key velocity vp, the central processing unit 111 determines the depressed key velocity vp on the basis of the time difference. The central processing unit 111 stores the depressed key velocity vp in the random access memory 113 for the depressed key 10*a* or 10*b*.

When the central processing unit 111 finds a released key 10*a* or 10*b*, the central processing unit 111 determines the key number k assigned to the released key 10*a* or 10*b* and the released key time tn. The central processing unit 111 stores the key number k of the released key 10*a* or 10*b* and the released key time tn in the random access memory 113 for the released key 10*a* or 10*b*.

Subsequently, the central processing unit 111 periodically checks the key position data table to see whether or not the key position of released key 10*a* or 10*b* is decreased to a predetermined key stroke. While the released key 10*a* or 10*b* is traveling on the way to the predetermined key stroke, the answer is given negative, and the central processing unit 111 stands idle for the released key 10*a* or 10*b*.

When the released key 10*a* or 10*b* reaches the predetermined key stroke, the central processing unit 111 reads a time at which the released key 10*a* or 10*b* reaches the predetermined key stroke from the software clock, and calculates time difference between the read-out time and the released key time tn so as to determine the released key velocity vn. The released key velocity vn is stored in the random access memory 113 for the released key 10*a* or 10*b*.

The key motion analyzer 200 intermittently repeats the above-described data processing for each of the depressed keys 10*a* and 10*b* and each of the released key 10*a* or 10*b*. The depressed key velocity vp is determined at the time later than the determination of key number k and depressed key time tp, and the released key velocity vn is also determined at the time later than the determination of key number k and released key time tn. When the parameter or parameters k, tp, vp, k, tn and vn are determined for the depressed key 10*a* or 10*b* or the released key 10*a* or 10*b*, the key motion analyzer 200 stores the parameter or parameters k, tp, vp, tn, k and vn in the random access memory 113 as described hereinbefore. In this connection, the key motion analyzer 200 makes the parameters k, tp, vp, k and vn correlated with one another in the random access memory 113 by using a suitable index.

Figure 4:
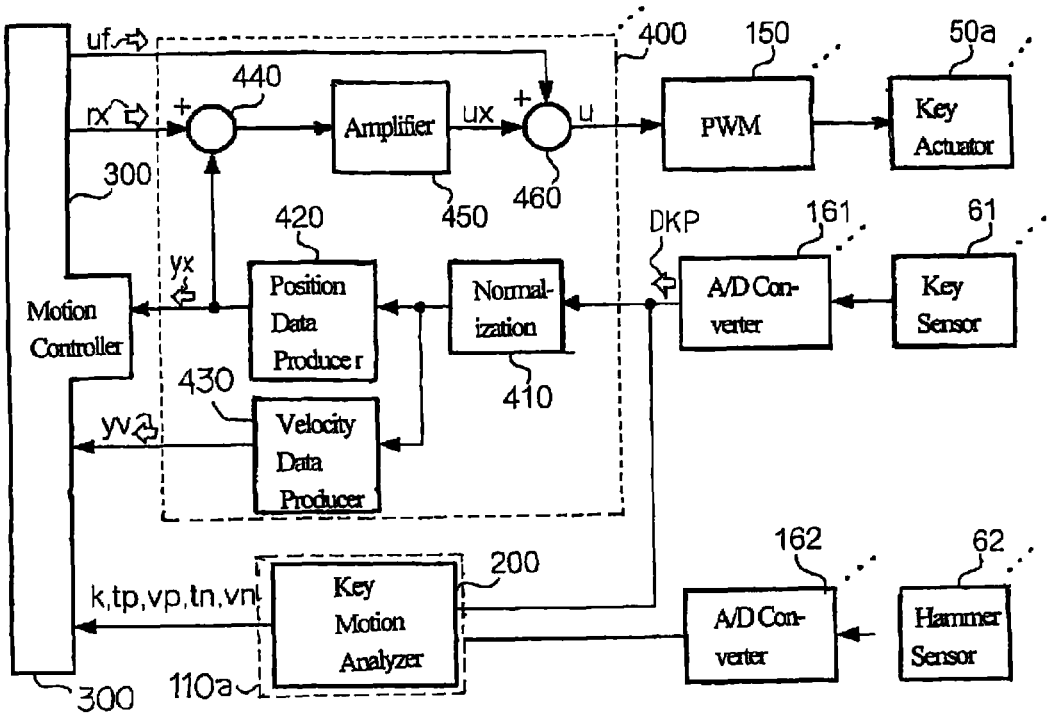
FIG. 4 is a block diagram showing a servo controller realized through execution of a subroutine program for an automatic accompaniment.

Turning to FIG. 4, the software module 400, i.e., servo controller 400 includes software blocks 410, 420, 430, 440, 450 and 460, which are called as "normalization", "position data producer", "velocity data producer", "subtractor" and "adder", respectively. A set of the software blocks 420, 430, 440, 450 and 460 is realized for each of the white keys 10*a* and black keys 10*b* to be moved. If more than one key 10*a* and 10*b* is to be concurrently moved, plural sets of software blocks 420, 430, 440, 450 and 460 are prepared for the more than one key 10*a* and 10*b*. The software block 410 is shared among all of the analog-to-digital converters 161, i.e., all of the white keys 10*a* and black keys 10*b*.

The normalization block 410 eliminates a deviation from the value of digital key position signal DKP. The white keys 10*a* and black keys 10*b* have respective individualities, and the key sensors 61 also have respective individualities. These individualities are undesirable for the servo control. For this reason, the deviation, which is due to the individualities, is eliminated from the value of digital key position signal DKP.

The position data producer 420 determines an actual key position yx from the normalized value of digital key position signals DKP for the key 10*a* or 10*b* to be moved, and puts the value of actual key position yx in the queue created in the key position data table for the key 10*a* or 10*b*.

The velocity data producer 430 accesses the key position data table, and reads out the actual key position yx from the queue assigned to the key 10*a* or 10*b* to be moved. The velocity data producer 430 determines an actual key velocity yv from a series of values of the actual key position yx, and is stored in the random access memory 113.

The actual key position yx and target key position rx are supplied to the subtractor 440. The value of actual key position yx is subtracted from the value of target key position rx, and a positional deviation is determined as the difference between the actual key position yx and the target key position rx.

The amplifier 450 amplifies or multiplies the positional deviation by a predetermined gain, and determines a mean current ux. A corrective factor uf, which is indicative of a variation due to offset current in the optical key sensor 61, is supplied from the motion controller 300 to the adder 460, and the adder 460 adds the corrective factor uf to the mean current ux. The sum u is indicative of a target mean current, and is supplied to the pulse width modulator 150 as a control signal.

The pulse width modulator 150 is responsive to the control signal so as to adjust the driving pulse signal DR to the target mean current, and supplies the driving pulse signal DP to the solenoid-operated key actuator 50*a* associated with the white key 10*a* or black key 10*b* to be moved.

The target key position rx and actual key position yx are periodically renewed, and the above-described servo control sequence is repeated so as to make the white key 10*a* or black key 10*b* travel on the reference key trajectory for automatic performance support.

Figure 5:
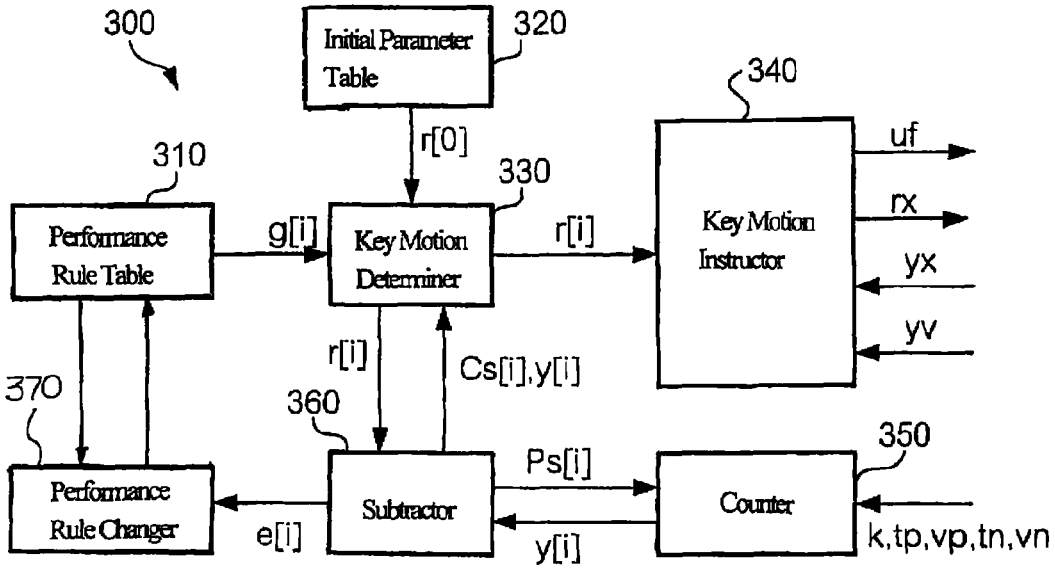
FIG. 5 is a block diagram showing a motion controller realized through the execution of the subroutine program for the automatic accompaniment.

Turning to FIG. 5, the software module 300, i.e., the motion controller 300 includes a key motion determiner 330, a key motion instructor 340, a counter 350, a subtractor 360 and a performance rule changer 370. The performance rule table and initial parameter table are respectively labeled with 310 and 320 in FIG. 5.

When a user instructs the central processing unit 111 to execute the instruction codes of the subroutine program for the passage performance mode, the key motion determiner 330 reads out the target driving vector r[0] from the initial parameter table 320. The key motion determiner 330 transfers the target driving vector r[0] to the subtractor 360 and further to the key motion instructor 340. The data transfer to the key motion instructor 340 starts at a certain time prior to the depressed key time rtp[0] by a time period so as make it possible to move the white key 10*a* or black key 10*b*, which is specified with the target key number rk[0] at the target depressed key time rtp[0].

While the central processing unit 111 is operating in the passage performance mode, the key motion determiner 330 periodically determines the target driving vector r[i], and stores the target driving vector r[i] in the driving parameter table. As a result, the subtractor 360 and key motion instructor 340 can read out the driving vectors r[i] from the driving parameter table as if the key motion determiner 330 directly transfers the driving vectors r[i] to the subtractor 360 and key motion instructor 340.

Although the target driving vector r[0] is stored in the initial parameter table 320, the other target driving vectors r[1], r[2], . . . are not stored, and are determined on the basis of the scheduled displacement vectors g[i] and detected key motion vectors y[i] through the key motion determiner 330. The detected key motion vectors y[i] are read out from the detected key motion parameter table as if the detected key motion vectors y[i] are directly supplied from the subtractor 360 to the key motion determiner 330, and each of the detected key motion vectors y[i] contains actual key motion parameters yk[i], ytp[i], yvp[i], ytn[i] and yvn[i], and expresses the actual movements of the white key 10*a* or black key 10*b* determined on the basis of the pieces of key position data. [i] is the index.

The first actual key motion parameter yk[i] expresses an actually key number k assigned to the white key 10*a* or black key 10*b* already moved, and is fallen within the range between 1 and 88.

The second actual key motion parameter ytp[i] expresses an actual depressed key time at which the white key 10*a* or black key 10*b* starts to travel toward the end position, and the unit of actual depressed key time ytp[i] is millisecond. The actual depressed key time is measured from the initiation of passage performance as similar to the depressed key time tp.

The third actual key motion parameter yvp[i] expresses an actual depressed key velocity of the depressed key 10*a* or 10*b*, and is fallen within the range between 1 and 127.

The fourth actual key motion parameter ytn[i] expresses an actual released key time of the released key 10*a* or 10*b* at which the white key 10*a* or black key 10*b* is released, and the unit of actual released key time ytn[i] is millisecond. The actual released key time expresses the lapse of time from the initiation of passage performance.

The fifth actual key motion parameter yvn[i] expresses an actual released key velocity of the released key 10*a* or 10*b*, and the actual released key velocity is fallen within the range between 1 and 127.

When the detected key motion vector y[0] is read out from the detected key motion parameter table subtractor 360 to the key motion determiner 330, the key motion determiner 330 further reads out the scheduled displacement vector g[1] from the performance rule table 310, and determines the target driving vector r[1] for the white key 10*a* or black key 10*b* to be next moved. The target driving vector r[1] is determined as $$r[1]=y[0]+g[1] \quad \text{Equation 1}$$

The key motion determiner 330 makes the target driving vector r[1] read out from the driving parameter table to the key motion instructor 340. When the certain time, which is earlier than the target depressed key time rtp[1] by the time period, comes, the target driving vector r[1] is read out from the detected key motion parameter table to the key motion instructor 340.

The above-described process is generalized as $$r[m+1]=y[m]+g[m+1] \quad \text{Equation 2}$$

where m is zero and a natural number. Equation 2 stands for the following equations 2-1 to 2-5.

$$rk[m+1]=yk[m]+gk[m+1] \quad \text{Equation 2-1}$$

$$rtp[m+1]=ytp[m]+gtp[m+1] \quad \text{Equation 2-2}$$

$$rvp[m+1]=yvp[m]+gvp[m+1] \quad \text{Equation 2-3}$$

$$rtn[m+1]=ytn[m]+gtn[m+1] \quad \text{Equation 2-4}$$

$$rvn[m+1]=yvn[m]+gvn[m+1] \quad \text{Equation 2-5}$$

While the central processing unit 111 is reiterating the subroutine program for the passage performance, the subtractor 360 periodically writes the detected key motion vectors y[m], y[m+1], y[m+2], . . . into the detected key motion parameter table so as make the key motion determiner 330 accessible to the detected key motion vectors y[m], y[m+1], y[m+2], . . . , and the key motion determiner 330 also periodically accesses the performance rule table 310 for reading out the scheduled displacement vectors g[m+1], g[m+2], g[m+3], . . . . The key motion determiner 330 determines the target driving vectors r[m+1], r[m+2], r[m+3], . . . as indicated by Equation 2 so as periodically to make the key motion instructor 340 accessible to the target driving vectors r[m+1], r[m+2], r[m+3], . . . .

The detected key motion vectors y[i] are stepwise written into the detected key motion parameter table by the subtractor 360 under the condition that the white keys 10*a* and black keys 10*b* are traveling between the rest positions and the end positions. If a human player depresses a white key 10*a* or a black key 10*b* before the initiation of key movement defined by the target driving vector r[m+1], the subtractor 360 raises the flag indicative of the stop sign Cs[m+1], and prohibits the white key 10*a* or black key 10*b* from the movement defined by the target driving vector r[m+1]. In other words, the driving pulse signal DR is not supplied from the pulse width modulator 150 to the white key 10*a* or black key 10*b*, which is assigned the target key number rk[m+1], and the white key 10*a* or black key 10*b* is not moved.

Thus, the stop sign Cs[m] prohibits the white key 10*a* or black key 10*b* assigned the target key number rk[m] from movement defined by the target driving vector r[m]. In case where target driving vector r[m] has been already outputted, it is impossible to stop the key movement defined by the target driving vector r[m] so that the stop sign Cs[m] is ignored.

The key motion instructor 340 accesses the target driving vectors r[i] in the driving parameter table, and periodically determines the target key position rx and the corrective factor uf at intervals equivalent to the servo control cycles, which in turn are equal to the sampling cycles on the key position signals KP.

The actual key position yx and actual key velocity yv are periodically supplied from the servo controller 400 to the key motion instructor 340 so that the motion controller 300 takes actual key position yx and actual key velocity yv into account for determining the corrective factor uf. The target key position rx and corrective factor uf are supplies to the servo controller 400 as described in conjunction with the servo controller 400 with reference to FIG. 4.

In case where a user requests the standard automatic performance to the automatic playing system 110, the target key position rx and corrective factor uf are determined on the basis of the music data codes as described hereinbefore.

The counter 350 reads out the performance parameters k tp, vp, tn and vn from performance parameter table, in which the key motion analyzer 200 stores the performance parameters k tp, vp, tn and vn, and determines whether or not the index [i] is to be incremented. When the counter 350 finds the answer affirmative, the counter 350 increments the index [i] by one. The roll of counter 350 is unique to the automatic performance support. The counter 350 starts the jobs at the initiation of automatic performance with the assistance of the automatic performance support.

Figure 6:
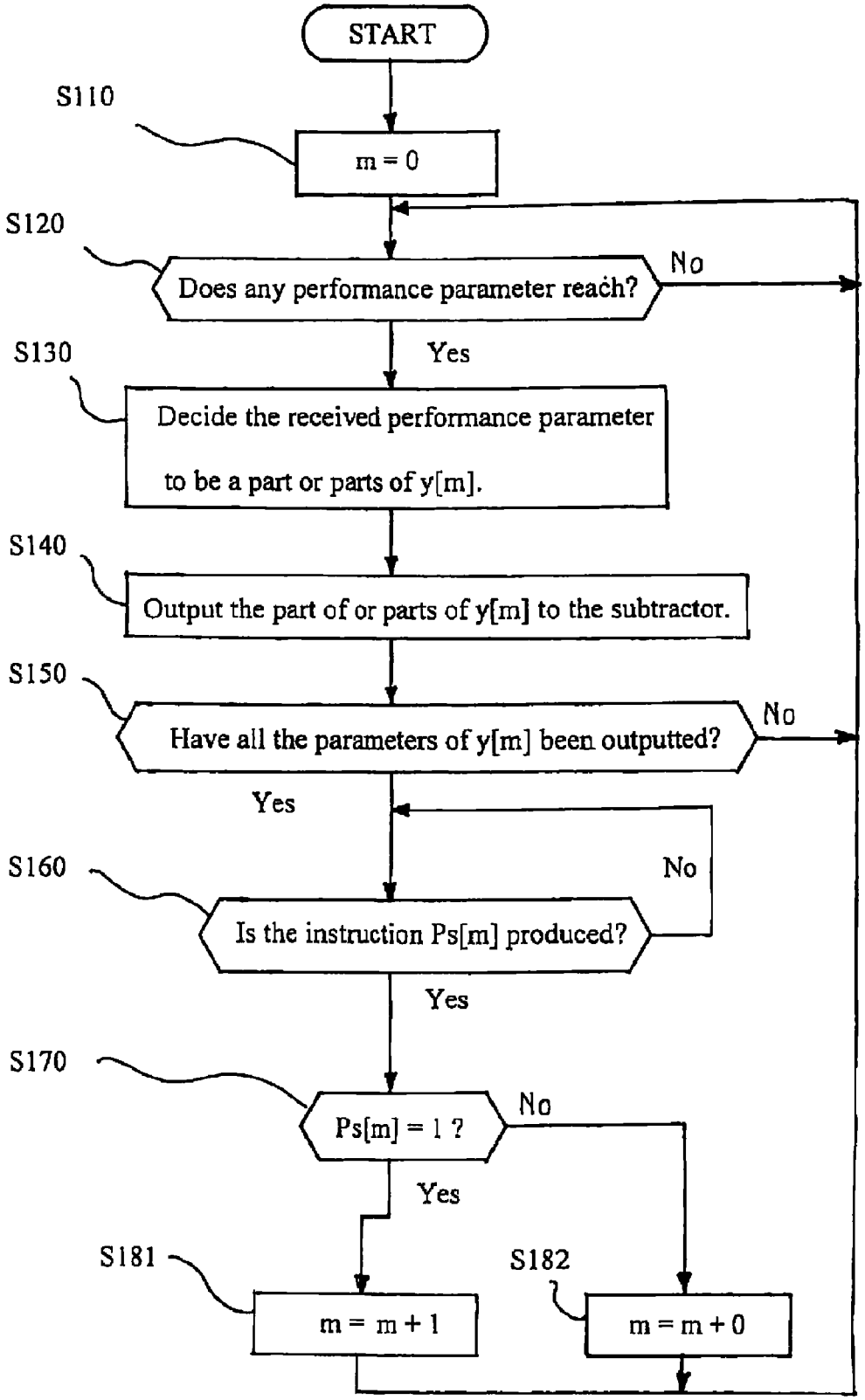
FIG. 6 is a flowchart showing a job sequence executed by a software module "counter" in the automatic accompaniment.

FIG. 6 shows a job sequence to be executed by the counter 350. First, the counter 350 sets the index [i] to zero, i.e., m=0 as by step S110, and the counter 350 checks the random access memory 113 to see whether or not any performance parameter is newly stored in the performance parameter table as by step S120. While the answer at step S120 is given negative "No", the counter 350 periodically checks the random access memory for a new performance parameter.

When a new performance parameter or new performance parameters are stored in the performance parameter table of the random access memory 113, the answer at step S120 is changed to affirmative "Yes", and the counter 350 makes the corresponding key motion parameter or corresponding key motion parameters of the detected key motion vector y[i] consistent with the new performance parameter or new performance parameters as by step S130. For example, when a new performance parameter k reaches the performance parameter table, the counter 350 makes the actual key number yk[m] consistent with the key number expressed by the new performance parameter k, and stores the actual key number yk[m] in the detected key motion parameter table of the random access memory 113 so that the subtractor 360 becomes accessible to the new actual key number yk[m] in the detected key motion parameter table.

Subsequently, the counter 350 outputs the key motion parameter or key motion parameters of the detected key motion vector y[i] to the subtractor 360 as by step S140. Thereafter, the counter 350 checks the random access memory 113 to see whether or not all the actual key motion parameters of detected key motion vector y[m] have been already outputted as by step S150. If at least one of the actual key motion parameters such as, for example, the actual released key velocity yvn[m] has not been outputted, yet, the answer at step S150 is given negative "No", and the counter 350 returns to the step S120.

As described hereinbefore, the performance parameters k, tp, vp, tn and vn are stepwise produced by the key motion analyzer 200. While the white key 10*a* or black key 10*b* is being depressed, the performance parameter k indicative of the key number is firstly produced, subsequently, the performance parameter tp indicative of the depressed key time is produced, and the performance parameter indicative of the depressed key velocity vp follows. On the other hand, while the released key 10*a* or 10*b* is traveling toward the rest position, the performance parameter tn indicative of the released key time is produced, and the performance parameter vn indicative of the released key velocity follows. For this reason, the counter 350 reiterates the loop consisting of steps S120 to S150 for storing the detected key motion parameters yk[m], ytp[m], yvp[m], ytn[m] and yvn[m] in the detected key motion parameter table until the answer at step S150 is changed to affirmative "Yes".

When all of the key motion parameters yk[m], ytp[m], yvp[m], ytn[m] and yvn[m] are stored in the detected key motion parameter table, the answer at step S150 is changed to affirmative "Yes", and the counter 350 checks the random access memory 113 to see whether or not the subtractor 360 has given an instruction Ps[m] for the detected key motion vector y[m] thereto as by step S160.

If the subtractor 360 is still under preparation of the instruction Ps[m], the answer at step S160 is given negative "No". With the negative answer, the counter 350 repeats the job at step S160, and waits for the instruction Ps[m]. The instruction Ps[i] expresses whether the counter 350 increments the index [i] or keeps the index [i] unchanged, and have value of 1 or zero.

When the instruction Ps[m] reaches the counter 350, the answer at step S160 is changed to affirmative "Yes". With the positive answer "Yes", the counter 350 checks the instruction to determine whether the instruction has the value of 1 or zero as by step S170. When the counter 350 finds the instruction Ps[m] to be 1, the counter 350 increments the index [i] from m to m+1 as by step S181. On the other hand, when the counter 350 finds the instruction Ps[m] to be zero, the counter 350 keeps the index [i] unchanged, i.e., zero as by step S182. Thus, the counter reiterates the loop consisting of the steps S120 to S181 or S182 until completion of the automatic performance in the passage performance mode.

Turning back to FIG. 5, the subtractor 360 reads out the detected key motion vector y[i] and target driving vector r[i] from the detected key motion parameter table and driving parameter table, and determines the instruction Ps[i], stop sign Cs[i] and a deviation vector e[i]. The subtractor 360 stores the instruction Ps[i], stop sign Cs[i] and deviation vecfor e[i] in the random access memory 113. As a result, the counter 350 becomes accessible to the instruction Ps[i], the key motion determiner 330 becomes accessible to the stop sign Cs[i] as well as the detected key motion vector y[i], and the performance rule changer 370 becomes accessible to the deviation vector e[i].

The deviation vector e[i] is defined as $$e[m]=y[m]-r[m] \quad \text{Equation 3}$$

The deviation vector e[i] have deviation parameters, which express a key number deviation ek[i], a depressed key time deviation etp[i], a depressed key velocity deviation evp[i], a released key time deviation etn[i] and a released key velocity deviation evn[i], respectively. The deviation parameters ek[i], etp[i], evp[i], etn[i] and evn[i] are calculated as $$ek[m]=yk[m]-rk[m]$$

$$etp[m]=ytp[m]-rtp[m]$$

$$evp[m]=yvp[m]-rvp[m]$$

$$etn[m]=ytn[m]-rtn[m]$$

$$evn[m]=yvn[m]-rvn[m]$$

Figure 7:
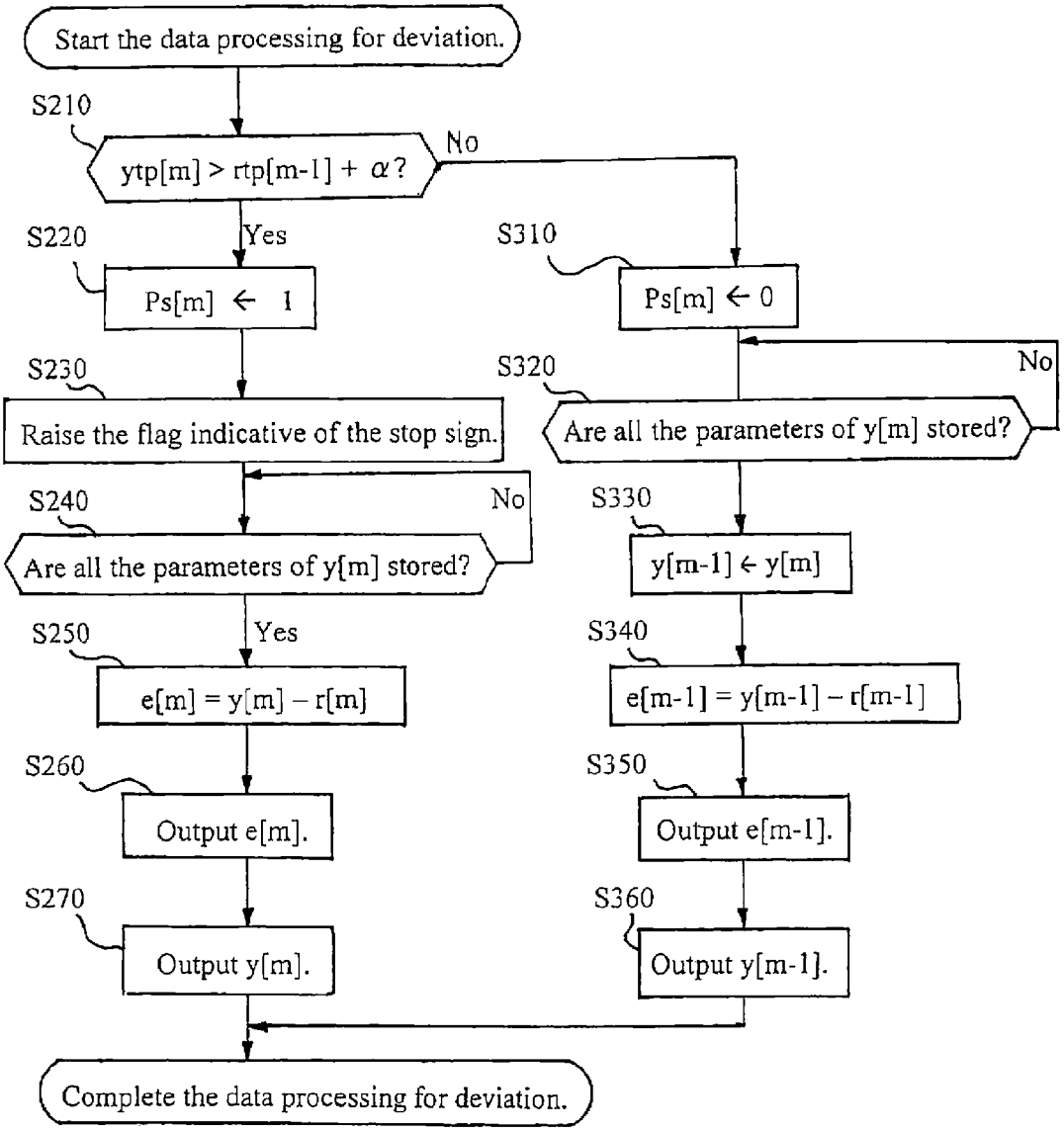
FIG. 7 is a flowchart showing a job sequence executed by a software module "subtractor" in the automatic accompaniment.

FIG. 7 shows a job sequence for realizing the subtractor 360. The subtractor 360 firstly determines whether the detected key motion vector y[m] expresses the movement of the white key 10*a* or black key 10*b* labeled with [m] or the movement of the white key 10*a* or black key 10*b* labeled with [m−1]. In this instance, the subtractor 360 compares the detected depressed key time ytp[m] with the target key depressed time rtp[m−1] to determine whether or not the detected depressed key time ytp[m] is greater than the sum of the target key depressed time rtp[m−1] and a predetermined margin α as by step S210. In this instance, the margin α is given as (rtp[m]−rtp[m−1])/2.

If the detected depressed key time ytp[m] is closer to the target depressed key time rtp[m], the detected key motion vector y[m] expresses the movement of the white key 10*a* or black key 10*b* labeled with [m], and the answer at step S210 is given affirmative "Yes". The subtractor 360 decides that the instruction Ps[m] is to be 1 as by step S220. On the other hand, when the detected depressed key time ytp[m] is closer to the target depressed key time rtp[m−1] than the target depressed key time rtp[m], the answer at step S210 is given negative "No", and the subtractor 360 decides that the instruction Ps[m] is to be zero as by step S310. The instruction Ps[m] is stored in the random access memory 113. Thus, the subtractor 360 permits the counter 350 to acquire the instruction Ps[m]. The counter 350 increments or keeps the index m depending upon the value of instruction Ps[m]. (See steps S170, S181 and S182 in the flowchart shown in FIG. 6.) The next job is different between the job at step S220 and the job at step 310 as follows.

If the subtractor 360 gives value "1" to the instruction Ps[m] at step S220, the subtractor 360 raises the flag indicative of the stop sign Cs[m] as by step S230, and permits the key motion determiner 330 to acquire the stop sign Cs[m]. As described hereinbefore, the key motion determiner 330 is responsive to the stop sign Cs[m] so as to prohibit the key motion instructor 340 from the access to the target driving vector r[m].

In more detail, if a human player depresses the white key 10*a* or black key 10*b* identified with the target key number rk[m] before the initiation of key movement defined by the target driving vector r[m], the subtractor 360 acknowledges the initiation of key movement by the human player through the comparison between the detected depressed key time ytp[m] and the sum of the target depressed key time rtp[m] and the margin α. In this situation, the flag indicative of the stop sign Cs[m] is raised so as to prohibit the key motion instructor 340 from the access to the target driving vector r[m]. As a result, the servo controller 400 does not permit the pulse width modulator 150 to supply the driving pulse signal DR to the solenoid-operated key actuator 50*a* associated with the target key number rk[m]. If the white key 10*a* or black key 10*b* has been already moved on the basis of the target driving vector r[m], the key motion analyzer 200 writes the detected key motion vector y[m] in the detected key motion table, and the subtractor 360 acquires the detected key motion vector y[m]. In this situation, the flag indicative of the stop sign Cs[m] is raised. However, the stop sign Cs[m] is ignored.

Subsequently, the subtractor 360 determines whether or not all of the actual key motion parameters of detected key motion vector y[m] have been already stored in the detected key motion parameter table as by step S240. If the answer at step S240 is given negative "No", the subtractor 360 periodically repeats the job at step S240. When the subtractor 360 finds all of the actual key motion parameters of detected key motion vector y[m] in the detected key motion parameter table, the answer at step S240 is changed to affirmative "Yes", and the subtractor 360 determines the deviation vector e[m] through the subtraction y[m]−r[m] as by step S250. The subtractor 360 writes the deviation vector e[m] into the deviation parameter table, and permits the parameter rule changer 370 to acquire the deviation vector e[m] as by step S260. The subtractor 360 further permits the key motion determiner 330 to acquire the detected key motion vector y[m] as by step S270.

On the other hand, in case where the subtractor 360 gives value "0" to the instruction at step S310, the subtractor 360 checks the detected key motion table to determine whether or not all of the actual key motion parameters of detected key motion vector y[m] have been already stored in the detected key motion parameter table as by step S320. If the answer at step S320 is given negative "No", the subtractor 360 repeats the job at step S320, and waits for change of the answer.

When the subtractor 360 finds all of the actual key motion parameters of detected key motion vector y[m] in the detected key motion parameter table, the answer at step S320 is changed to affirmative "Yes". With the positive answer at step S320, the subtractor 360 substitutes the detected key motion vector y[m] for the detected key motion vector y[m−1] as by step S330. In other words, the index [i] is changed from [m] to [m−1]. This is because of the fact that it is made clear in the job at step S210 that the detected key motion vector y[m] expresses the details of movement of the key 10*a* or 10*b* defined by the target driving vector r[m−1].

Subsequently, the subtractor 360 determines the deviation vector e[m−1] through the calculation of (y[m−1]−r[m−1]) as by step S340. The subtractor 360 writes the deviation vector e[m−1] into the deviation parameter table, and permits the performance rule changer 370 to access to the deviation vector e[m−1] as by S350. Moreover, the subtractor 360 writes the detected key motion vector y[m−1] into the detected key motion parameter table, and permits the key motion determiner 330 to access to the detected key motion vector y[m−1].

The subtractor 360 repeats the loop consisting of steps S210 to S360 upon acquisition of the detected key motion vector y[i].

Turning back to FIG. 5, the performance rule changer 370 reads out the deviation vector e[i] from the deviation parameter table, and changes the scheduled displacement vector g[i] as $$g[m+1]=g[m]+e[m] \quad \text{Equation 4}$$

Equation 4 stands for the following equations $$gk[m+1]=gk[m]+ek[m] \quad \text{Equation 4-1}$$

$$gtp[m+1]=gtp[m]+etp[m] \quad \text{Equation 4-2}$$

$$gvp[m+1]=gvp[m]+evp[m] \quad \text{Equation 4-3}$$

$$gtn[m+1]=gtn[m]+etn[m] \quad \text{Equation 4-4}$$

$$gvn[m+1]=gvn[m]+evn[m] \quad \text{Equation 4-5}$$

As described hereinbefore in conjunction with the job at step S350, the subtractor 360 writes the deviation vector e[m−1] instead of the deviation vector e[m] into the deviation parameter table on the condition that the acquired detected key motion vector y[m] expresses the key movement defined by the target driving vector r[m−1]. In this situation, the performance rule changer 370 changes the scheduled displacement vector g[m] instead of the scheduled displacement vector g[m+1].

Examples of Behavior in Massage Performance

A human player is assumed to select the passage performance mode, i.e., the automatic performance with the assistance of automatic performance support for the passages from the job list on the panel display 130. The human player specifies a music tune on the panel display 130, and gives the information processing unit 110*a* time at which the automatic performance is to be start. A set of key control data codes, which expresses the selected music tune, is transferred from the disk driver 120 to the random access memory 113, and the target driving vector r[0] is read out from the initial parameter table 320 to the information processing unit 110*a*. The information processing unit 110*a* waits for the time to start the passage performance.

The time to start the automatic performance comes. Then, the main routine program starts to branch to the subroutine program for the passage performance mode, i.e., the automatic performance with the assistance of automatic performance support, and the software modules 200, 300 and 400 are enabled.

The target driving vector r[0] is assumed to have the following driving parameters; rk[0]=40, rtp[0]=1000, rvp[0]=64, rtn[0]=1500 and rvn[0]=64. The scheduled displacement vector g[0] is assumed to have the following scheduled key motion parameters; gk[0]=0, gtp[0]=1000, gvp[0]=0, gtn[0]=1000, gvn[0]=0. The key number "40" is assigned to the white key "C", which is usually found at the center of the keyboard 10. If the scheduled key motion parameters g[i] are not changed, the white key "C" is depressed at interval of 1000 milliseconds, and the initiation of key release is 500 milliseconds later than the initiation of depressing the key 10*a*. The depressed key velocity vp is "64", and the released key velocity vn is also "64". The acoustic tone "C" is generated at interval of 1 second.

Turning to FIG. 8 of the drawings, the performance rule table 310, initial parameter table 320, driving parameter table, detected key motion table and deviation parameter table are shown for the parameters labeled with the index [i] from [0] to [10]. In the detected key motion table, white keys 10*a* assigned the key numbers 42 and 47 are put in the boxes drawn by thick lines, and the thick lines are indicative of the keys 10*a* and 10*b* moved by the human player. The driving parameters rk[0] and rtp[0] of target driving vector rk[0], which is read out from the initial parameter table 320, are indicative of 40 and 1000 so that the automatic playing system 110 causes the white key 10*a* assigned the key number 40 to start to travel toward the end position at 1000 milliseconds later than the initiation of the automatic playing in the passage performance mode. The white key 10*a* assigned the key number 40 starts to return toward the rest position at 500 milliseconds later than the initiation of downward movement, i.e., 1500 milliseconds later than the initiation of passage performance as indicated by rtn[0].

Since the scheduled key motion parameters gk[0], gtp[0] and gtn[0] are 0, 1000 and 1000, the automatic playing system 100 causes the white key 10*a* assigned the key number 40 to start to travel toward the end position, again, at 2000 milliseconds later than the initiation of passage performance, and the depressed key 10*a* is released at 2500 milliseconds later than the initiation of passage performance. The white key assigned the key number 40 is correctly depressed and released by the solenoid-operated key actuators 50*a* as indicated by the detected key motion vectors y[0] and y[1] so that the deviation vectors e[0] and e[1] are zero.

Although the automatic playing system 100 is to depress the white key 10*a* assigned the key number 40 at time equivalent to the index of 2, the human player depresses the white key 10*a* assigned the key number 42 immediately before the initiation of key movement expressed by the target driving vector r[2]. Although the white key 10*a* assigned the key number 42 starts to travel at a certain time slightly later than the depressed key time 3000, depressed key time ytp[2] of 3000 is written at the box in the detected key motion table for the sake of simplicity. As a result, the detected key motion vector y[2] has the actual key motion parameter yk[2] of 42. The other actual key motion parameters ytp[2], ytn[2] and yvn[2] are equal to the sum of the actual key motion parameters ytp[1], yvp[1], ytn[1], yvn[1] and the scheduled key motion parameters gtp[2], gvp[2], gtn[2], gvn[2], i.e., 3000, 64, 3500 and 64.

In this situation, the movement of white key 10*a* assigned the key number 42 prohibits the white key 10*a* assigned the key number 40 from the movement indicated by the target driving vector r[2]. On the other hand, if the human player depresses the white key 10*a* assigned the key number 42 immediately after the initiation of movement of the white key assigned the key number 40, the counter 350 prepares the detected key motion vector y[3] on the basis of the performance parameters k, tp, vp, to and vn. However, the subtractor 360 changes the detected key motion vector y[3] to the detected key motion vector [2] at step S330. Since the index [i] is not incremented, the counter 350 prepares the detected key motion vector y[3] on the basis of the next performance parameters, again.

When the human player depresses the white key 10*a* assigned the key number 42, the subtractor 360 writes the key number deviation of 2 at the deviation parameter ek[2] in the deviation parameter table. The performance rule changer 370 replaces the scheduled key motion parameter gk[2] of zero with the scheduled key motion parameter gk[3] of 2. This results in the movement of white key 10*a* assigned the key number 44 at 4000 milliseconds later than the initiation of the passage performance and the movement of black key 10*b* assigned the key number 46 at 5000 milliseconds later than the initiation of passage performance. The acoustic piano tones "E" and "F#" are generated. Thus, the automatic playing system 110 plays the upward glissando instead of the repetition of tone "C".

The human player depresses the white key 10*a* assigned the key number 47 instead of the key 10*b* assigned the key number 50 at 7000 milliseconds later than the initiation of passage performance mode. The subtractor 360 determines that the key number deviation ek[6] is −3, and the performance rule changer 370 changes the scheduled key motion parameter gk[6] of 2 to the scheduled key motion parameter gk[7] of −1 in the similar manner. The black key 10*b* assigned the key number 46 starts to move at 8000 millisecond later than the initiation of passage performance for producing the acoustic piano tone "F#", and the white key 10*a* assigned the key number 45 starts to move at 9000 milliseconds later than the initiation of passage performance for producing the acoustic piano tone "F". Thus, the automatic playing system 110 plays the downward glissando.

As will be understood from the foregoing description, if the human player moves the white keys 10*a* and black keys 10*b* different from those expressed by the target driving vector r[i] in the automatic performance with the association of automatic performance support, the subtractor 360 compares the details of movements of the keys 10*a* and 10*b* to be moved with the details of movements of the keys actually moved so as to determine differences in the details of movements between the keys 10*a* and 10*b* to be moved and the keys 10*a* and 10*b* actually moved, and the performance rule changer 370 changes the performance rule in real time fashion on the basis of the differences of details of movements. This feature is desirable for the human player, because he or she can change a part of the music tune to a passage such as the glissando in real time fashion during the automatic performance.

Second Embodiment

Figure 9:
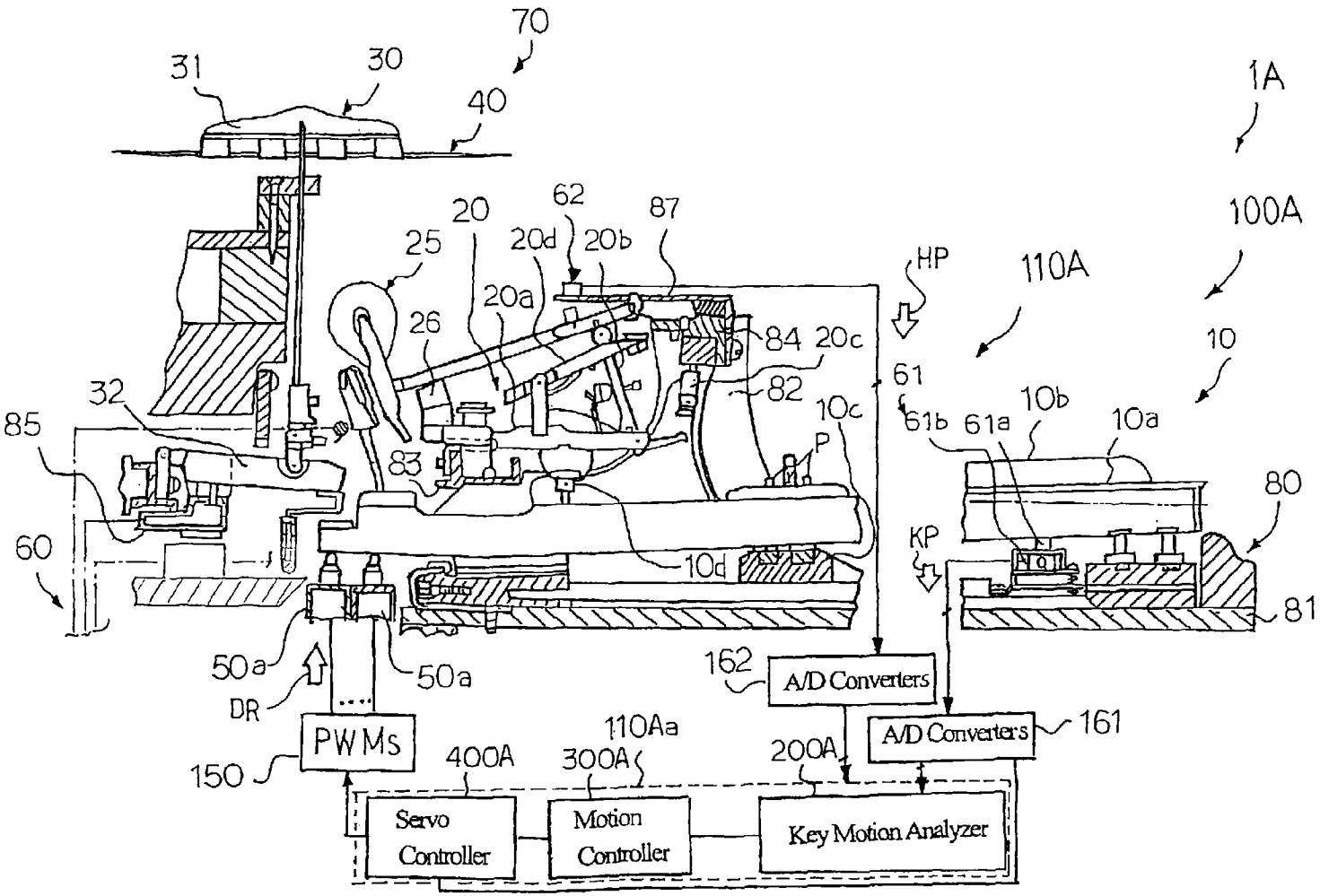
FIG. 9 is a cross sectional side view showing the structure of an acoustic piano and software modules forming parts of another automatic player piano.

Turning to FIG. 9, another automatic player piano 1A embodying the present invention largely comprises an acoustic piano 100A and an automatic playing system 110A. The acoustic piano 100A is similar to the acoustic piano 100 so that component parts of the acoustic piano 100A are labeled with the same references designating the corresponding component parts of acoustic piano 100 without detailed description for the sake of simplicity.

The automatic playing system 110A is similar to the automatic playing system 110 except for some jobs in a subroutine program for the automatic performance support. For this reason, although an information processing unit, a key motion analyzer, a motion controller and a servo controller of the automatic playing system 110A are labeled with 110Aa, 200A, 300A and 400A, the other system components and other software modules are labeled with the same references designating the corresponding system components and corresponding software modules of the automatic playing system 110.

A computer program, which runs on the central processing unit 111 of the information processing system 110A, is also broken down into a main routine program and subroutine programs. Although the subroutine program for the passage performance mode is different from that of the first embodiment, the main routine program and other subroutine programs are similar to those of the information processing unit 110. For this reason, description is focused on the differences of the subroutine program for the passage performance mode.

The key motion analyzer 200A, motion controller 300A and servo controller 400A are realized through execution of the subroutine program for the passage performance mode. The roll of key motion analyzer 200A and the roll of servo controller 400A are similar to those of the key motion analyzer 200 and servo controller 400 so that description is focused on the motion controller 300A.

Figure 10:
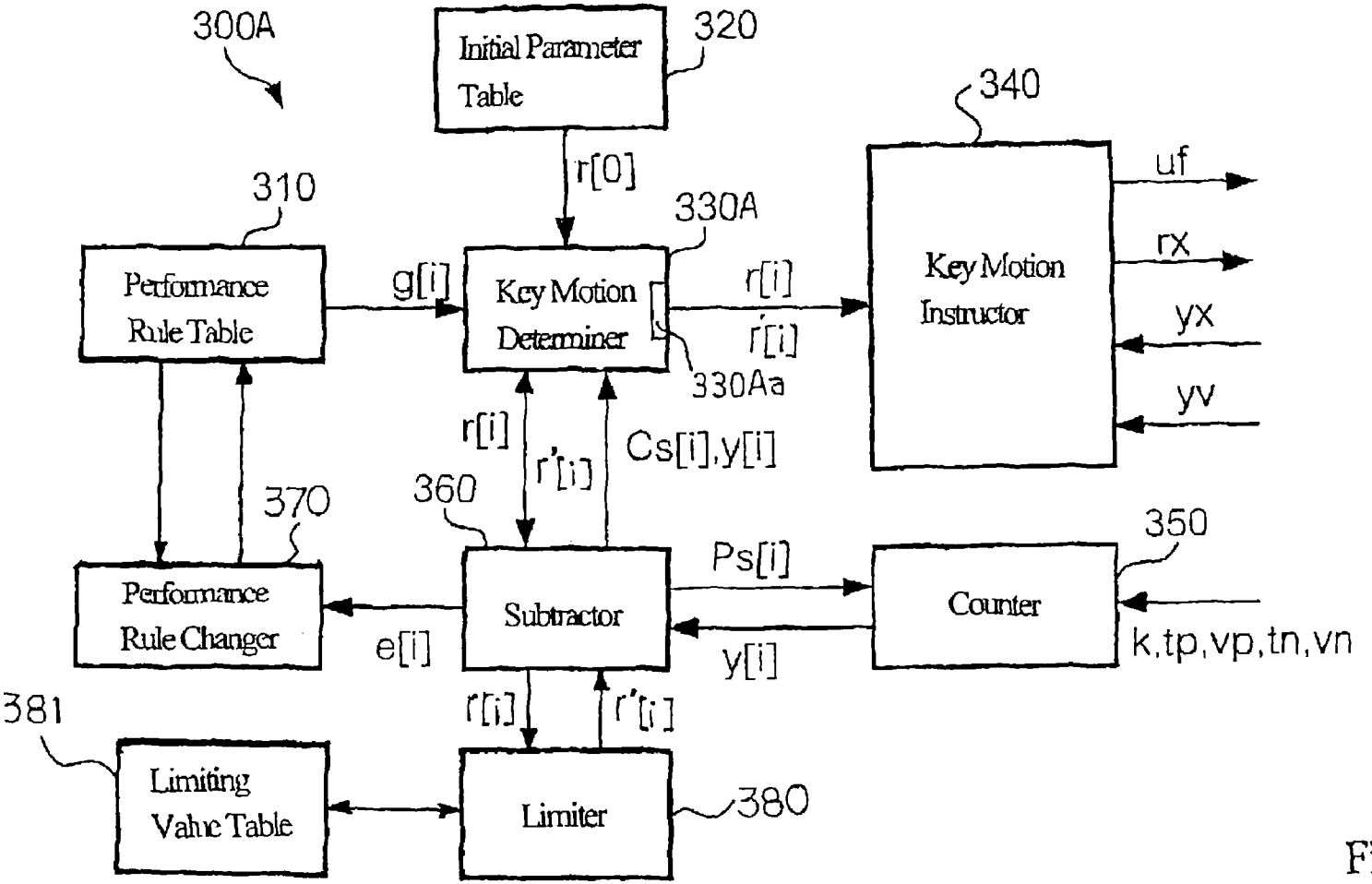
FIG. 10 is a block diagram showing software bocks of a motion controller realized in an automatic playing system of the automatic player piano.

FIG. 10 shows software blocks of the motion controller 300A. The motion controller 300A includes a key motion determiner, a key motion instructor, a counter, a subtractor, a performance rule changer and a limiter 380. Since the key motion determiner, key motion instructor, counter, subtractor and performance rule changer are similar to those of the motion controller 300. For this reason, the key motion determiner, key motion instructor, counter, subtractor and performance rule changer are labeled with the same references 330, 340, 350, 360 and 370 in FIG. 10 without detailed description.

A limiting value table 381 is prepared in the random access memory 113, and an upper limiting value and a lower limiting value are stored in the limiting value table 381 for each of the driving parameters of target driving vector r[i]. When the key motion determiner 330 determines the target driving vector r[i], the key motion determiner 330 permits the limiter 380 to access the target driving vector r[i]. The limiter 380 reads out the upper limiting values and lower limiting values of driving parameters from the limiting value table 381, and compares the driving parameters with the upper limiting values and lower limiting values to determine whether or not the driving parameters are fallen within the ranges between the upper limiting values and the lower limiting values. If the limiter 380 finds a driving parameter or driving parameters to be out of the range or ranges, the limiter 380 replaces the driving parameter or driving parameters with the upper limiting value/upper limiting values or the lower limiting value/lower limiting values, and rewrites the modified target driving vector r'[i] into the driving parameter table. For this reason, the key motion instructor 340 and subtractor 360 carry out the jobs on the basis of the modified target driving vector r'[i].

Turning to FIG. 11 of the drawings, the performance rule table 310, initial parameter table 320, driving parameter table, detected key motion table and deviation parameter table are shown from for the parameters labeled with the index [i] from [0] to [10].

The human player moves the keys 10*a* and 10*b* assigned the key numbers of "2" and "4" at the time equivalent to index of "2" and the time equivalent to index "6" instead of the keys assigned the key numbers of "1" and "6". Moreover, the human player depresses the keys 10*a* and 10*b* faster than the target depressed key velocity rvp[2] and rvp[6], and releases the depressed keys 10*a* and 10*b* slower than the target released key velocity rvn[2] and rvn[6]. In other words, the human player makes the reference key trajectory changed as well as the keys to be moved.

Although the depressed keys at the index [9] and index [10] are to be each increased from 127 by 17, the target depressed key velocity rvp[9] and rvp[10] are restricted 127. This is because of the fact that the upper limiting value of the target depressed key velocity rvp[i] is 127. When the key motion determiner 330 adds the scheduled depressed key velocity gvp[8] of 17 to the target depressed key velocity rvp[8], the limiter 380 finds the target depressed key velocity rvp[9] exceeds the upper limiting value of 127 so that the target depressed key velocity rvp[9] of 144 is replaced with the modified target depressed key velocity rvp'[9] of 127. The target depressed key velocity rvp[10] is further replaced with the modified target depressed key velocity rvp'[10] of 127.

Although the scheduled released key velocity gvn[8] is −17, the target released key velocity rvn[9] is 1. This is because of the fact that the lower limiting value of target released key velocity rvn[i] is 1.

As will be understood from the foregoing description, although the human player depresses the keys assigned the key numbers 2 and 4, the passage performance smoothly proceeds as similar to the first embodiment. Moreover, the limiter 380 does not permit the target driving parameters to exceed the upper limiting values and lower limiting values so that the listeners are free from uncomfortable impression.

Third Embodiment

Figure 12:
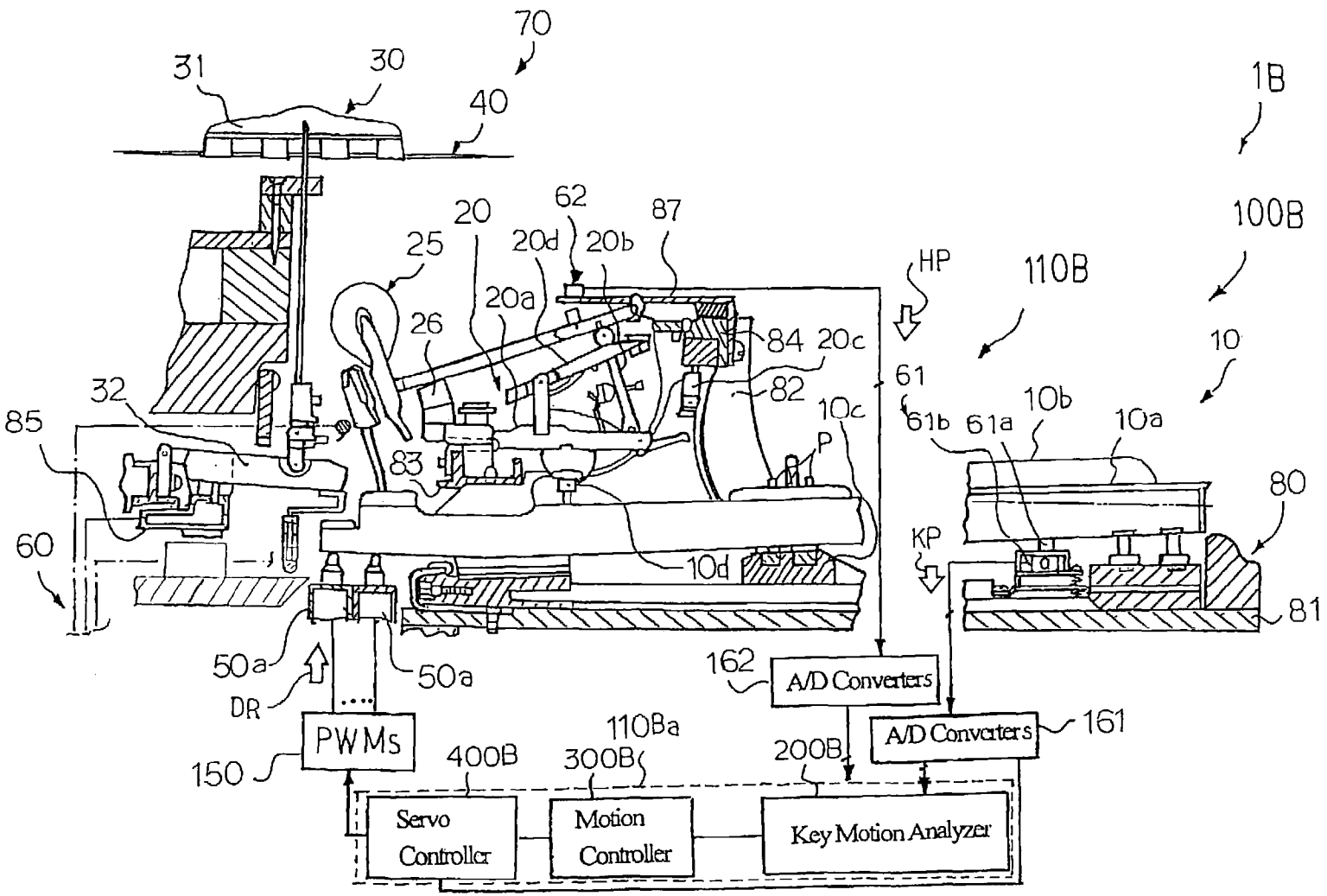
FIG. 12 is a cross sectional side view showing the structure of an acoustic piano and software modules forming parts of yet another automatic player piano.

Turning to FIG. 12 of the drawings, yet another automatic player piano embodying the present invention 1B largely comprises an acoustic piano 100B and an automatic playing system 110B. The acoustic piano 100B is similar to the acoustic piano 100 so that component parts of the acoustic piano 100B are labeled with the same references designating the corresponding component parts of acoustic piano 100 without detailed description for the sake of simplicity.

The automatic playing system 110B is similar to the automatic playing system 110 except for some jobs in a subroutine program for the passage performance mode. For this reason, although an information processing unit, a key motion analyzer, a motion controller and a servo controller of the automatic playing system 110B are labeled with 110Ba, 200B, 300B and 400B, the other system components and other software modules are labeled with the same references designating the corresponding system components and corresponding software modules of the automatic playing system 110.

A computer program, which runs on the central processing unit 111 of the information processing system 110B, is also broken down into a main routine program and subroutine programs. Although the subroutine program for the passage performance rule is different from that of the first embodiment, the main routine program and other subroutine programs are similar to those of the information processing unit 110. For this reason, description is focused on the differences of the subroutine program for the passage performance mode.

The key motion analyzer 200B, motion controller 300B and servo controller 400B are realized through execution of the subroutine program for the passage performance mode. The roll of key motion analyzer 200B and the roll of servo controller 400B are similar to those of the key motion analyzer 200 and servo controller 400 so that description is focused on the motion controller 300B.

Figure 13:
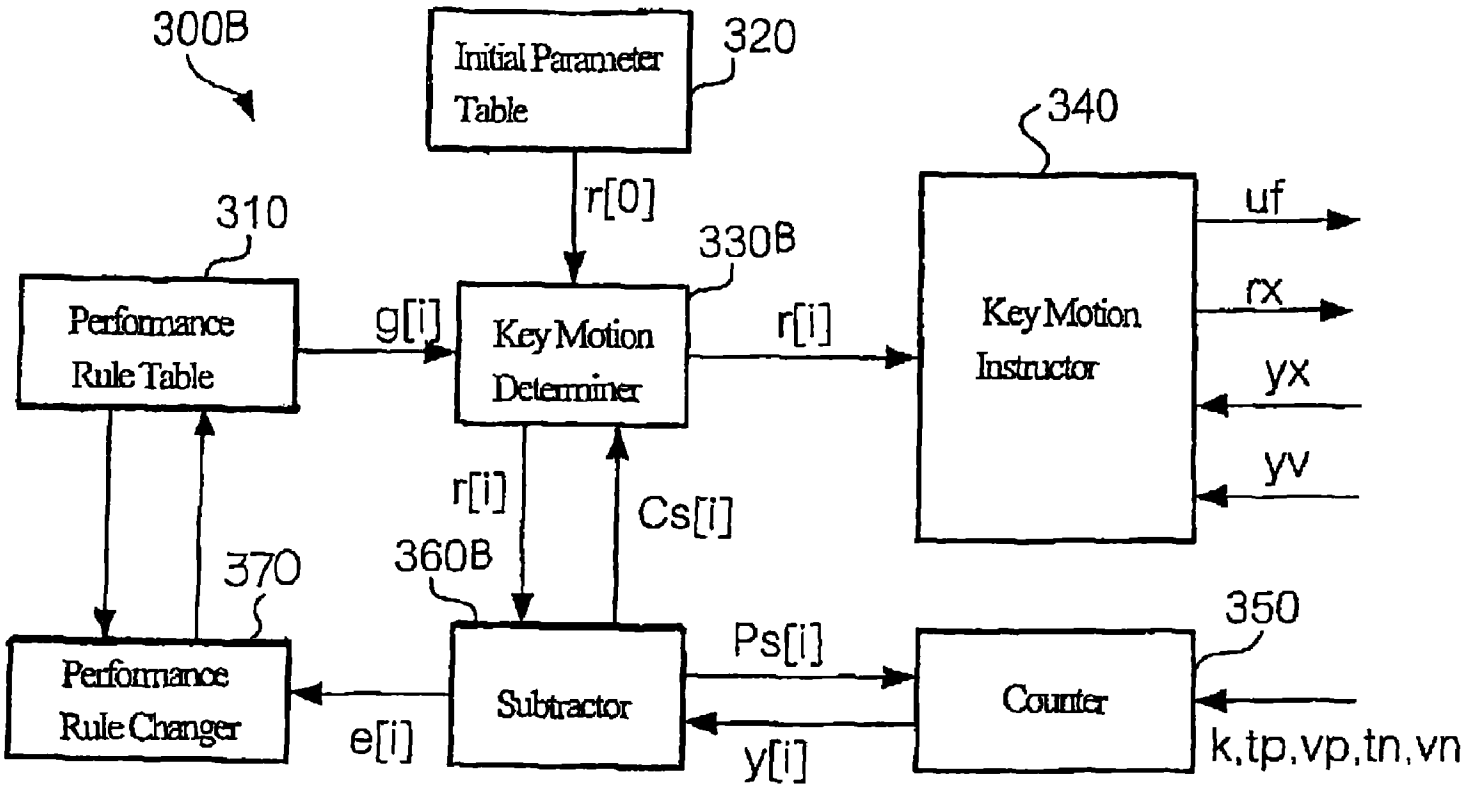
FIG. 13 is a block diagram showing software bocks of a motion controller realized in an automatic playing system of the automatic player piano.

FIG. 13 shows software blocks of the motion controller 300B. The motion controller 300B includes a key motion determiner, a key motion instructor, a counter, a subtractor and a performance rule changer. Since the key motion instructor, counter and performance rule changer are similar to those of the motion controller 300. For this reason, the key motion instructor, counter and performance rule changer are labeled with the same references 340, 350 and 370 without detailed description, and the key motion determiner and subtractor 360B are labeled with different reference 330B and 360B in FIG. 13.

The subtractor 360B is different from the subtractors 360 and 360A in that the subtractor 360B does not need to permit the key motion determiner 330B to access the detected key motion vectors y[i]. This is because of the fact that the key motion determiner 330B determines the new target driving vector r[m+1] as the sum of the previous target driving vector r[m] and the scheduled displacement vector g[m+1], i.e., r[m]+g[m+1] instead of the sum of the detected key motion vector y[i] and the scheduled displacement vector g[m+1], i.e., y[m]+g[m+1]. In other words, although the scheduled displacement vector g[i] is added to the details of actual key motion, i.e., the contents of detected key motion vector y[i] in the key motion determiner 330 of first embodiment, the scheduled displacement vector g[i] is added to the details of target key motion, i.e., the contents of target driving vector r[i] in the key motion determiner 330B of third embodiment. Thus, even if a white key 10*a* or black key 10*b* is not moved in spite of the detailes of target movement expressed by the target driving vector, the key motion determiner 330B can prepare the next target driving vector on the basis of the unexecuted target driving vector.

FIG. 14 shows the contents of the performance rule table 310, initial parameter table 320, driving parameter table, detected key motion parameter table and deviation parameter table created in the random access memory 113 of information processing unit 110Ba.

The human player depresses the white key 10*a* assigned the key number 42 and black key 10*b* assigned the key number 46 at time equivalent to the index "2" and time equivalent to the index "6". For this reason, the actual key motion parameter yk[2] and yk[6] is different from the driving parameter rk[2] and rk[6], respectively.

Although the method employed in the key motion determiner 330B is different from the method employed in the motion key motion determiner 330, the passage performance smoothly proceeds through the roll of performance rule changer 370 as similar to the first embodiment.

Fourth Embodiment

Figure 15:
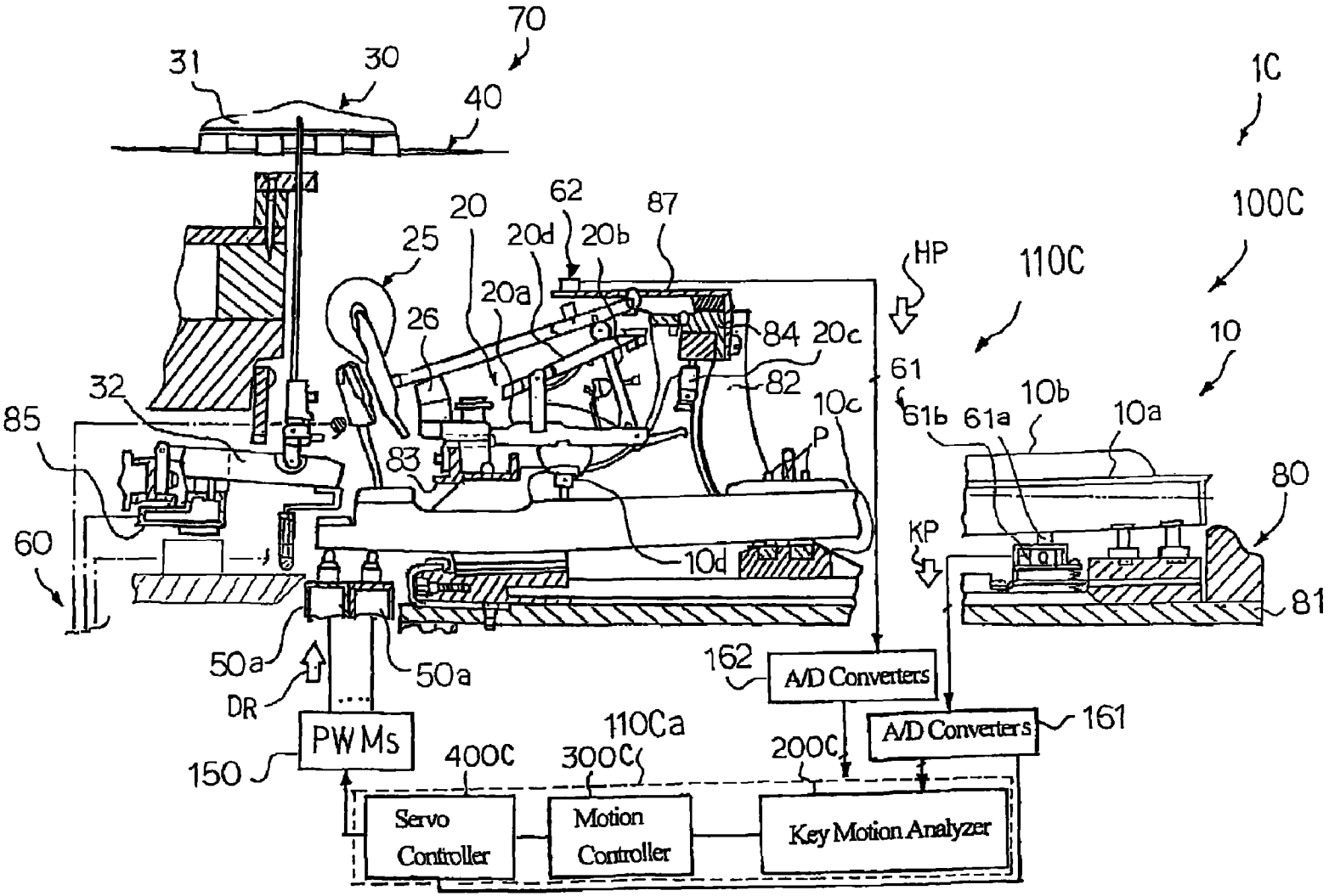
FIG. 15 is a cross sectional side view showing the structure of an acoustic piano and software modules forming parts of still another automatic player piano.
Figure 16:
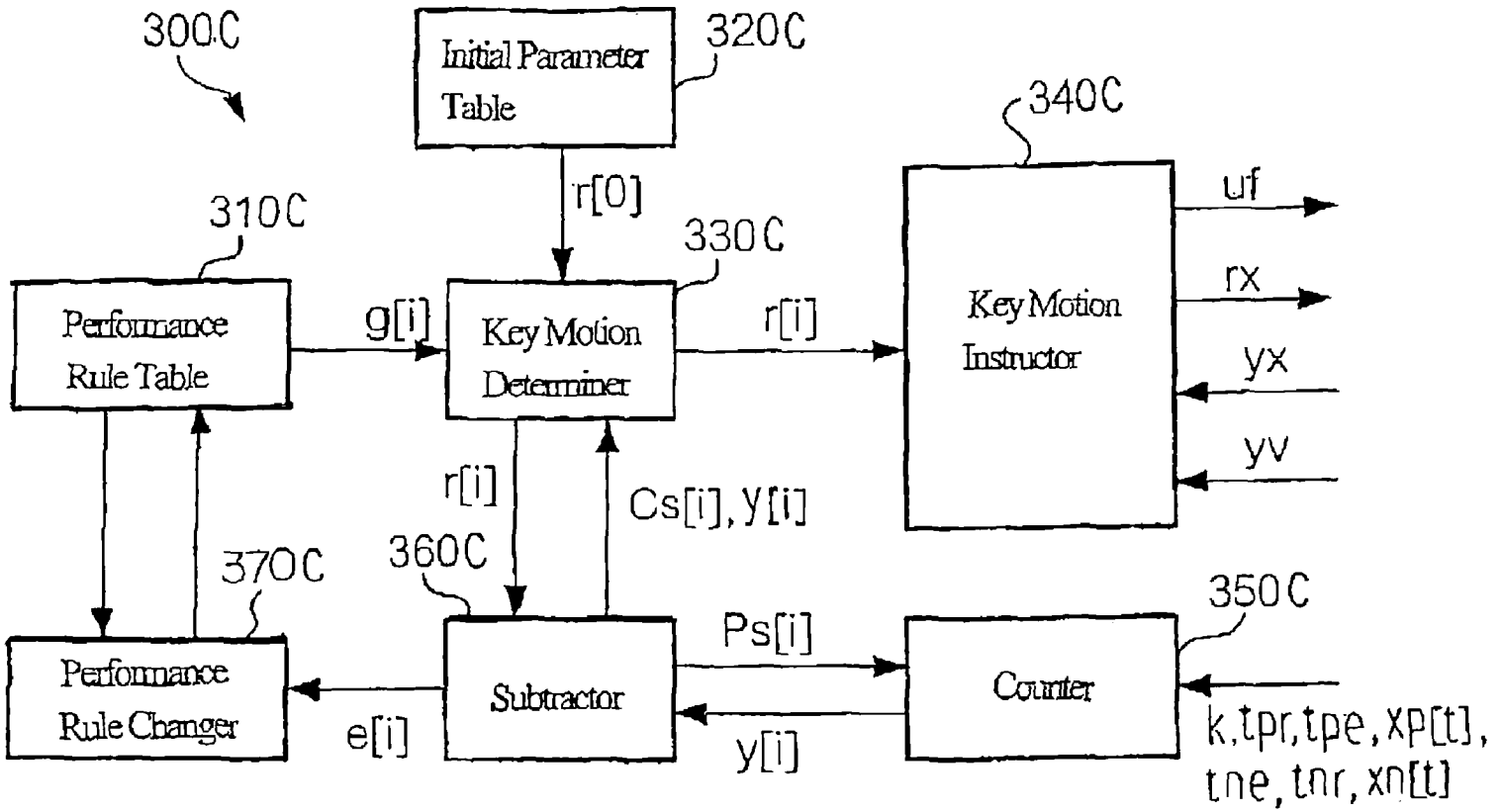
FIG. 16 is a block diagram showing software bocks of a motion controller realized in an automatic playing system of the automatic player piano.

Turning to FIG. 15 of the drawings, still another automatic player piano 1C embodying the present invention largely comprises an acoustic piano 100C and an automatic playing system 110C. The acoustic piano 100C is similar to the acoustic piano 100 so that component parts of the acoustic piano 100C are labeled with the same references designating the corresponding component parts of acoustic piano 100 without detailed description for the sake of simplicity. The automatic player piano 1C is prepared for eliminating the fluctuation from automatic performances expressed by a set of pieces of key control data. The eliminating work is referred to as "automatic regulation", and any human player does not participate in the automatic regulation.

The automatic playing system 110C is similar to the automatic playing system 110 except for a part of the computer program. Although the computer program is broken down into a main routine program and subroutine programs as similar to that of the first embodiment, the subroutine program for passage performance mode is replaced with a subroutine program for automatic regulation. For this reason, although an information processing unit, a key motion analyzer, a motion controller and a servo controller of the automatic playing system 110C are labeled with 110Ca, 200C, 300C and 400C, the other system components are labeled with the same references designating the corresponding system components of the automatic playing system 110.

A computer program, which runs on the central processing unit 111 of the information processing system 110C, is also broken down into the main routine program and subroutine programs as described hereinbefore. The main routine program and other subroutine programs are similar to those of the information processing unit 110. For this reason, description is focused on differences between the subroutine program for the passage performance mode and the subroutine program for automatic regulation without detailed description on the main routine program and other subroutine programs.

The key motion analyzer 200C, motion controller 300C and servo controller 400C are realized through execution of the subroutine program for the automatic regulation. The roll of key motion analyzer 200B, the roll of motion controller 300B and the roll of servo controller 400B are similar to those of the key motion analyzer 200, motion controller 300 and servo controller 400 except for performance parameters and corresponding parameters of vectors. Although the key motion analyzer 200, motion controller 300 and servo controller 400 are designed on the premise that the white keys 10*a* and black keys 10*b* take uniform motion between the rest positions and the end positions, the key motion analyzer 200C, motion controller 300C and servo controller 400C are prepared for the white keys 10*a* and black keys 10*b*, the depressed key velocity and released key velocity of which are varied between the rest positions and the end positions.

In detail, the key motion analyzer 200C determines the following performance parameters. The first performance parameter expresses the key number k as similar to the performance parameter employed in the key motion analyzer 200. The second performance parameter expresses a rest position departure time tpr, at which the white key 10*a* or black key 10*b* starts to move from the rest position toward the end position. The third performance parameter expresses an end position arrival time tpe, at which the white key 10*a* or black key 10*b* arrives at the end position. The fourth performance parameter expresses a depressed key trajectory xp[t], in which the key stroke is varied together with time t from the rest position to the end position. The fifth performance parameter expresses an end position departure time tne, at which the white key 10*a* or black key 10*b* starts to move from the end position toward the rest position. The sixth performance parameter expresses the rest position arrival time tnr, at which the white key 10*a* or black key 10*b* arrives at the rest position. The seventh performance parameter expresses a released key trajectory xn[t], in which the key stroke is varied together with time t from the end position to the rest position. In this instance, the rest positions are found at the keystroke of zero, and the end positions are spaced from the rest positions by 10 millimeters, and the key stroke on the depressed key trajectory and the key stroke on the released key trajectory are measured at intervals of 1 millisecond. In the depressed key trajectory xp[t], the time t is increased from the rest position departure time tpr. On the other hand, the time t is increased from the end position departure time the for the released key trajectory xn[t].

The rest position departure time tpr and end position departure time the are corresponding in meaning to the depressed key time tp and released key time tn.

FIG. 13 shows software blocks of the motion controller 300B. The motion controller 300B includes a key motion determiner 330C, a key motion instructor 340C, a counter 350C, a subtractor 360C and a performance rule changer 370C, and the key motion determiner 330C, key motion instructor 340C, counter 350C, subtractor 360C and performance rule changer 370C are selectively accessible to a performance rule table 310C, an initial parameter table 320C and other parameter tables as similar to those of the motion controller 300.

Scheduled displacement vectors g[i], target driving vectors r[i], detected key motion vectors y[i] and deviation vectors e[i] are corresponding to those employed in the motion controller 300 except for component parameters of the vectors g[i], r[i], y[i] and e[i]. As described hereinbefore, since the key motion analyzer 200C periodically prepares the performance parameters k, tpr, tpe, xp[t], tne, tnr and xn[t], each of the scheduled displacement vectors g[i], target driving vectors r[i], detected key motion vectors y[i] and deviation vectors e[i] contains parameters corresponding to the performance parameters k, tpr, tpe, xp[t], tne, tnr and xn[t]. For example, each of the detected key motion vectors y[i] includes actual key motion parameters yk[i], ytpr[i], ytpe[i], yxp[t][i], ytne[i], ytnr[i] and yxn[t][i], in which k, tpr, tpe, xp[t], tne, tnr and xn[t] expresses sorts of physical quantity same as those of the performance parameters k, tpr, tpe, xp[t], tne, tnr and xn[t].

Figure 17A:
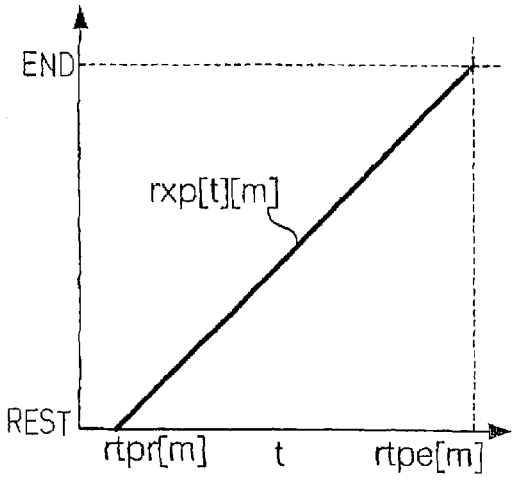
FIGS. 17A, 17B and 17C are graphs showing depressed key trajectories of a key incorporated in the automatic player piano.
Figure 17B:
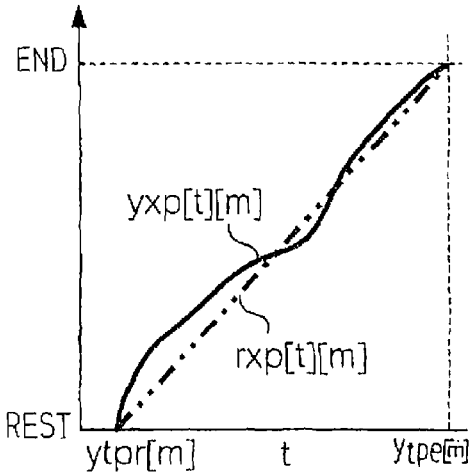
Figure 17C:
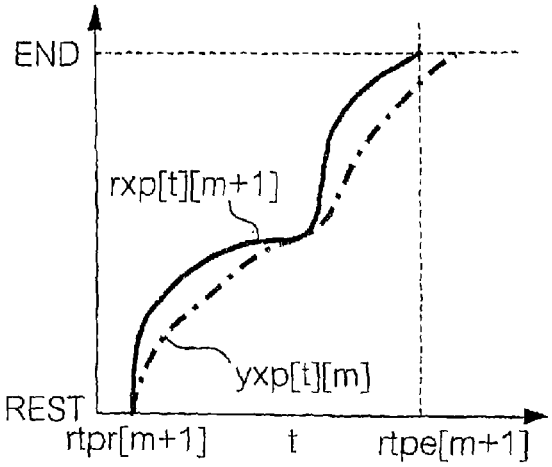

Description is hereinafter made on the behavior of automatic player piano 1C with reference to FIGS. 17A to 17C. FIG. 17A shows a movement of a key 10*a* or 10*b* expressed by the driving parameter rxp[t][m]. In the movement of key 10*a* or 10*b*, the scheduled key motion parameter gxp[t][m] is zero at all values of time [t]. FIG. 17B shows the actual key motion parameter yxp[t][m]. The driving parameter rxp[t][m] in FIG. 17B is the object of calculation for the difference from the actual key motion parameter yxp[t][m], and is expanded and shrunken in order to make it consistent with the time at which depressing operation is carried out. In fact, the time axis is varied as follows.

$$rxp[ytpr[m]+(ytpe[m]-ytpr[m])/(rtpe[m]-rtpr[m])\times t][i] \quad \text{Character Expression 1}$$

Prior to the determination of difference, the driving parameter rxp[t][i] is expanded and shrunken in the direction of time axis so as to make the time to move the key consistent with the reference time.

FIG. 11C shows the details of movement rxp[t][m+1] for the key 10*a* or 10*b* to be next moved as a result of the change of performance rule through the determination of difference on the basis of the relation shown in FIG. 11B. The driving parameter rxp[t][m+1], which is determined through the data processing in this embodiment, has time span equal to the time difference between the actual key motion parameter ytpr[m] and the actual key motion parameter ytpe[m]. For this reason, the driving parameter rxp[t][m+1] shown in FIG. 11C is to be expanded or shrunken in such a manner as to have the time space equal to the time difference between the driving parameter rtpr[m+1] and the driving parameter rtpe[m+1], and makes the reference time consistent with the driving parameter rtpr[m+1]. The time axis is varied as follows.

$$rxp[rtpr[m+1]+(rtpe[m+1]-rtpr[m+1])/(ytpe[m]-ytpr[m])\times t][m+1] \quad \text{Character Expression 2}$$

As will be understood, the time axes of different parameters expressing the depressed key trajectory are made consistent with each other before the data processing of the software blocks. The time axes are also made consistent with each other for the different parameters expressing the released key trajectory. Even if the movements of keys 10*a* and 10*b* fluctuate due to individualities of automatic player piano 1C, by way of example, the movements of keys 10*a* and 10*b* are automatically regulated through the expansion and/or shrinkage of time axes.

Fifth Embodiment

Figure 18:
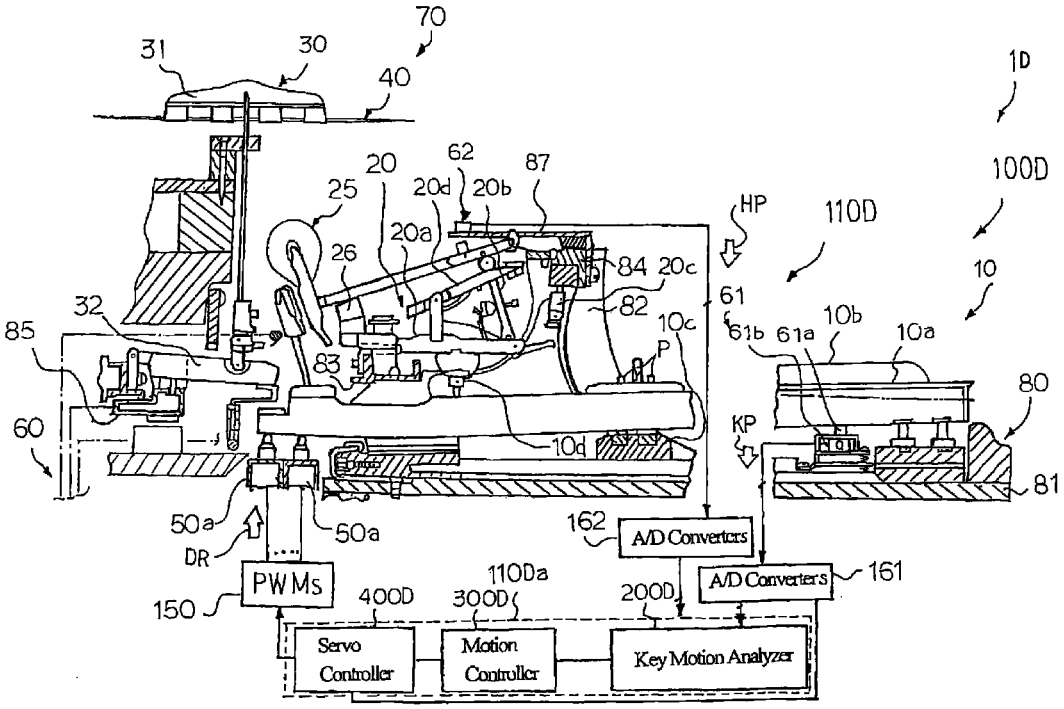
FIG. 18 is a cross sectional side view showing the structure of an acoustic piano and software modules forming parts of yet another automatic player piano.

Turning to FIG. 18 of the drawings, yet another automatic player piano embodying the present invention 1D largely comprises an acoustic piano 100D and an automatic playing system 110D. The acoustic piano 100D is similar to the acoustic piano 100 so that component parts of the acoustic piano 100D are labeled with the same references designating the corresponding component parts of acoustic piano 100 without detailed description for the sake of simplicity.

The automatic playing system 110D is similar to the automatic playing system 110 except for some jobs in a subroutine program for the passage performance mode. For this reason, although an information processing unit, a key motion analyzer, a motion controller and a servo controller of the automatic playing system 110D are labeled with 110Da, 200D, 300D and 400D, the other system components are labeled with the same references designating the corresponding system components of the automatic playing system 110.

A computer program, which runs on the central processing unit 111 of the information processing system 110D, is also broken down into a main routine program and subroutine programs. Although the subroutine program for the passage performance mode is different from that of the first embodiment, the main routine program and other subroutine programs are similar to those of the information processing unit 110. For this reason, description is focused on the differences of the subroutine program for the passage performance mode.

The key motion analyzer 200D, motion controller 300D and servo controller 400D are realized through execution of the subroutine program for the passage performance mode. The roll of key motion analyzer 200D and the roll of servo controller 400D are similar to those of the key motion analyzer 200 and servo controller 400 so that description is focused on the motion controller 300D.

Figure 19:
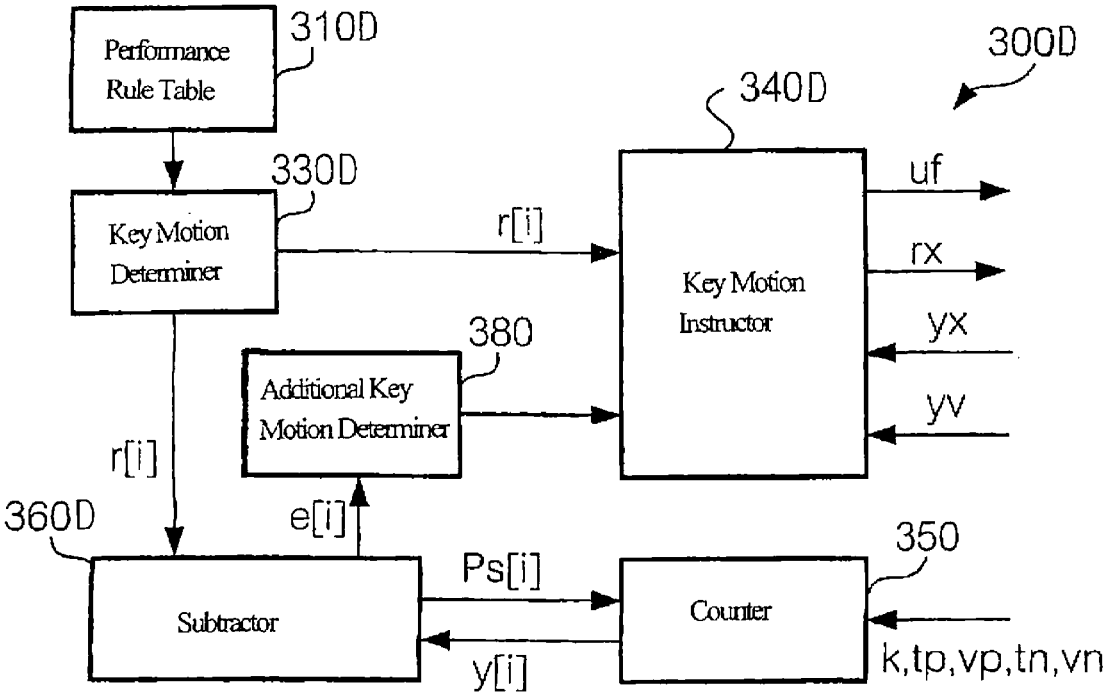
FIG. 19 is a block diagram showing software bocks of a motion controller realized in an automatic playing system of the automatic player piano.

As described hereinbefore, the performance table changer 370 is incorporated in the motion controller 300 so as to vary the scheduled displacement vector g[i] on the condition that the subtractor 360 finds a difference or differences between the detected key motion vector y[i] and the target driving vector r[i]. Any performance table changer is not incorporated in the motion controller 300D, and an additional key motion determiner 380 is provided in the motion controller 300D as shown in FIG. 19. In this arrangement, even if the subtractor 360D finds a difference or differences between the detected key motion vector y[i] and the target driving vector r[i], the scheduled displacement vector g[i] is not varied, but the additional motion determiner 380 determines a white key 10*a* or black key 10*b* on the basis of the deviation vector e[i] so as additionally to drive the white key 10*a* or black key 10*b* together with the white key 10*a* or black key 10*b* specified by the scheduled displacement vector g[i].

Although the details of movement of key 10*a* or 10*b* are determined on the basis of the scheduled displacement vector g[i] expressing the details of movement of previously moved key 10*a* or 10*b* in the first embodiment, a performance rule may be stored in the performance rule table 310D regardless of the details of movements of the previously moved keys 10*a* and 10B. MIDI music data codes, which specify a music tune to be performed, may be available for the performance rule, by way of example. The details of movement of keys 10*a* and 10*b*, which are moved by a human player, may be compared with the details of movement of keys expressed by the performance rule so as to determine the details of movement of a key 10*a* or 10*b*, and the determined details of movement are added to the details of movement of key 10*a* or 10*b* expressed by the performance rule for generation of a tone.

The motion controller 300D includes the key motion determiner 330D, key motion instructor 340D, counter 350, subtractor 360D and additional key motion determiner 380. When the subtractor 360D finds a difference or differences between the detected key motion vector y[i] and the target driving vector r[i], the subtractor 360D calculates the deviation vector e[i], which expresses the difference or differences, and supplies the deviation vector e[i] to the additional motion determiner 380 instead of the performance rule changer 370. Since the role of counter 350 is same as that of the motion controller 300, description on the counter 350 is omitted.

In the performance rule table 310D, a performance rule, which specifies a music tune to be performed like the MIDI music data codes, is stored in the performance rule table 310D. The key motion determiner 330D determines the target driving vector r[i] on the basis of the scheduled displacement vector y[i] read out from the performance rule table 310D, and permits the key motion instructor 340D to access the target driving vector r[i] so that the key motion instructor 340D determines the reference key trajectory for the key to be next moved. The subtractor 360D calculates a difference or differences between the detected key motion vector y[i] and the target driving vector r[i], and permits the additional key motion determiner 380 to access the deviation vector e[i] expressing the difference or differences. The method for determining the difference or differences is similar to that of the subtractor 360.

The additional key motion determiner 380 determines the details of movement of additionally moved key 10*a* or 10*b* on the basis of the deviation vector e[i] through a predetermined algorism, and permits the key motion instructor 340D to access the piece of information expressing the details of movement. The key motion instructor 340D determines the reference key trajectory on the basis of the piece of information produced by the additional key motion determiner 380 in addition to the reference key trajectory on the basis of the target driving vector r[i]. The key motion instructor 340D periodically supplies the target key position rx and corrective factor of to the servo controller 400D for the keys 10*a* and 10*b* specified by not only the target driving vector r[i] but also the piece of information, and forces the keys 10*a* and 10*b* to travel on the reference key trajectories.

The automatic playing system 110 D makes it possible that a human player can overlap the tones produced through the automatic performance with tones produced through his or her fingering.

Sixth Embodiment

Figure 20:
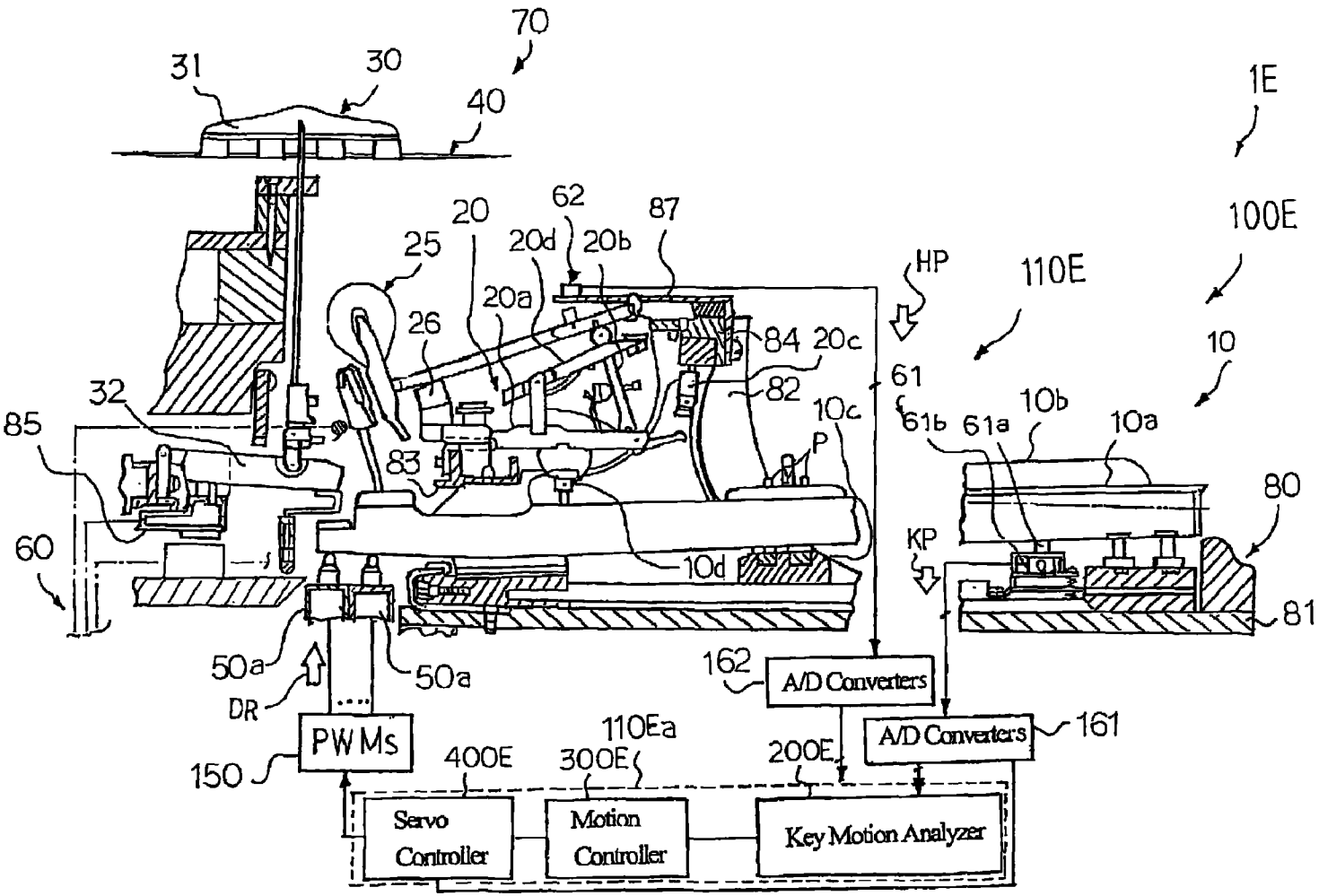
FIG. 20 is a cross sectional side view showing the structure of an acoustic piano and software modules forming parts of still another automatic player piano.

Turning to FIG. 20 of the drawings, still another automatic player piano embodying the present invention 1E largely comprises an acoustic piano 100E and an automatic playing system 110E. The acoustic piano 100E is similar to the acoustic piano 100 so that component parts of the acoustic piano 100E are labeled with the same references designating the corresponding component parts of acoustic piano 100 without detailed description for the sake of simplicity.

The automatic playing system 110E is similar to the automatic playing system 110 except for some jobs in a subroutine program for the passage performance mode. For this reason, although an information processing unit, a key motion analyzer, a motion controller and a servo controller of the automatic playing system 110E are labeled with 110Ea, 200E, 300E and 400E, the other system components are labeled with the same references designating the corresponding system components of the automatic playing system 110.

A computer program, which runs on the central processing unit 111 of the information processing system 110E, is also broken down into a main routine program and subroutine programs. Although the subroutine program for the passage performance mode is different from that of the first embodiment, the main routine program and other subroutine programs are similar to those for the information processing unit 110. For this reason, description is focused on differences of the subroutine program for the passage performance mode.

Figure 21:
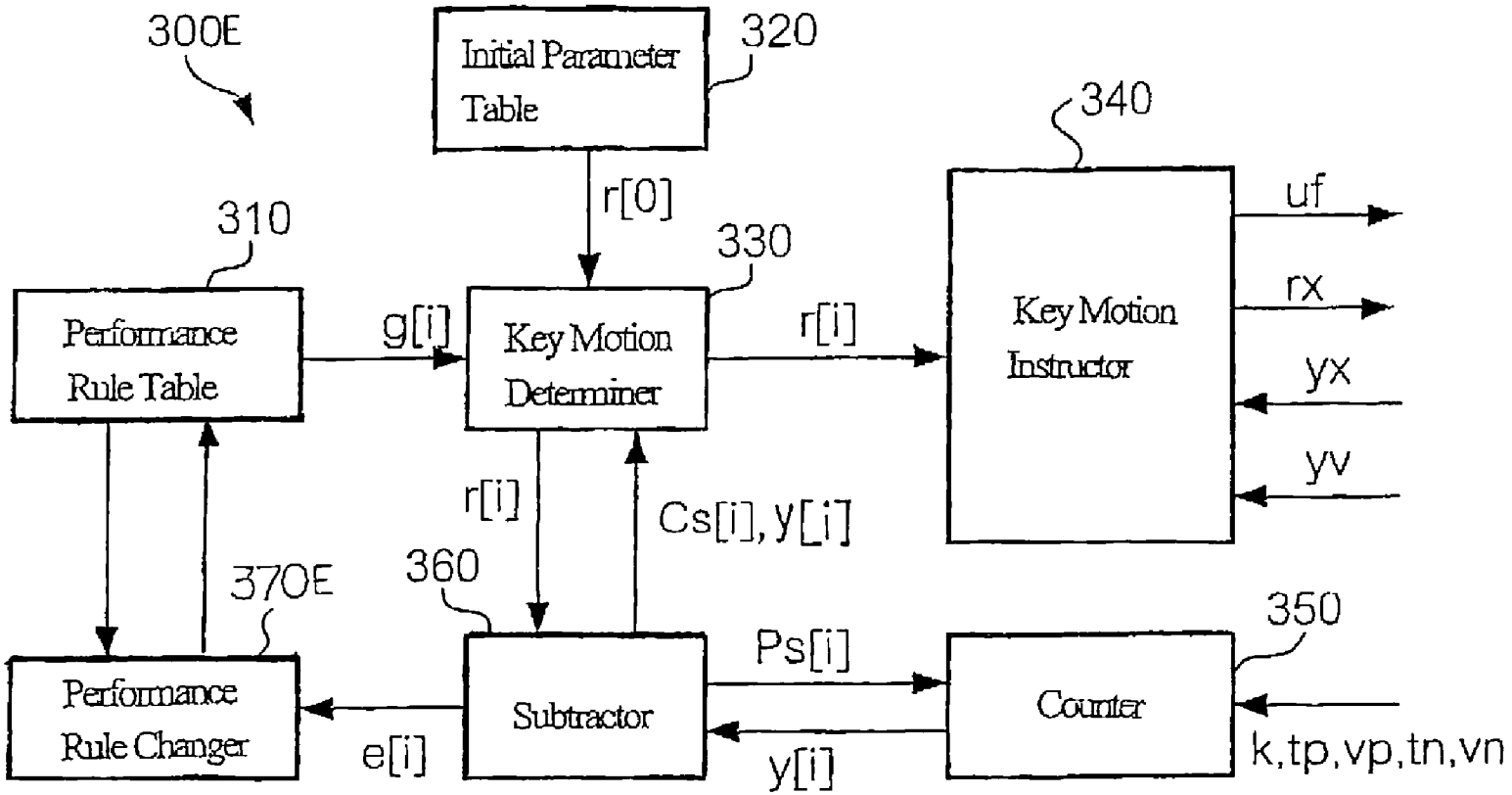
FIG. 21 is a block diagram showing software bocks of a motion controller realized in an automatic playing system of the automatic player piano.

FIG. 21 shows software blocks of the motion controller 300E. The software blocks of motion controller 300E are similar to those of the motion controller 300 except for a performance rule changer 370E. For this reason, the other software blocks are labeled with references designating the corresponding software blocks of motion controller 300 without detailed description.

As described in conjunction with the performance rule changer 370, the deviation vector e[m] is added to the scheduled displacement vector g[m] for the next scheduled displacement vector g[m+1], i.e., g[m+1]=g[m]+e[m]. The performance rule changer 370E determines the next scheduled displacement vector g[m+1] through an arithmetic operation different from that carried in the performance rule changer 370. The performance rule changer 370E adds the deviation vector e[m] to the first scheduled displacement vector g[0], i.e., g[m+1]=g[0]+e[m]. Thus, the next scheduled performance vector g[m+1] is determined on the basis of the past scheduled displacement vector g[0]. The next scheduled performance vector g[m+1] makes the automatic playing system 110E repeat the movement of key 10*a* or 10*b* depressed by the human player once.

Although particular embodiments of the present invention have been shown and described, it will be apparent to those skilled in the art that various changes and modifications may be made without departing from the spirit and scope of the present invention.

The built-in type automatic playing system does not set any limit to the scope of the present invention. A separate-type automatic playing system may be offered to users. The separate-type automatic playing system is put on a piano cabinet of an acoustic piano for the automatic performance, automatic performance with the assistance of automatic performance support or automatic regulation, and may be removed from the piano cabinet after the automatic performance, automatic performance with assistance of automatic performance support or automatic regulation. The separate-type automatic playing system can be combined with different models of an acoustic piano, and makes it possible to retrofit acoustic pianos to automatic player pianos.

A part of or all of the software modules 200, 300 and 400 may be implemented by wired logic gates. For example, the software blocks 440 and 460 may be implemented by wired-logic a subtractor and a wired-logic adder, and the software block 450 may be replaced with a wired-logic multiplier.

The automatic player piano 1 may be equipped with a hammer stopper. The hammer stopper is provided between the array of hammers 25 and the strings 40, and is changed between a free position and a blocking position. While the hammer stopper is staying at the free position, the hammers 25 are brought into collision with the associated strings 40 without any interruption of the hammer stopper. Thus, the hammer stopper at the free position permits the hammers to give rise to the acoustic piano tones through the vibrations of strings 40. On the other hand, when the hammer stopper is changed to the blocking position, the hammer stopper is moved on the hammer trajectories. In this situation, although the hammers 25 escape from the jacks, the hammers 25 rebound on the hammer stopper before reaching the strings 40. Thus, the hammer stopper allows the pianist to finger on the keyboard 10 without any acoustic piano tone.

While the pianist is fingering on the keyboard 10 on the condition that the hammer stopper stays at the blocking position, the information processing unit 110*a* analyzes the digital key position signals DKP and digital hammer position signals DHP for producing the music data codes, and the music data codes are transferred to the electronic tone generating system 140 so as to generate the electronic tones instead of the acoustic piano tones.

The hammer sensors 62 may be implemented by the optical position transducers of the type used as the key position sensors 61.

The hammer sensors 62 are not the indispensable element of the present invention. Only the key sensors 61 may be incorporated in the sensor system 160 for an automatic player piano of the present invention. In this instance, the final hammer velocity is calculated on the basis of the key velocity at reference points on the key trajectories, because the final hammer velocity is proportional to the key velocity at the reference points.

The margin $\alpha$ may be a fixed value such as, for example, 200 milliseconds.

The first to third embodiments do not set any limit to how to change the performance rule. For example, the performance rule may be applied on the basis of one of the keys 10*a* and 10*b* previously moved. Otherwise, the performance rule may be applied on the basis of a result of a calculation carried out on the details of movements of previously moved keys.

If the difference (rtpe[i]−rtpr[i]) in the character expressions is too long, there is a possibility not to generate the piano tone. For this reason, the upper limit such as, for example, 500 milliseconds may be set to the difference.

The depressed key trajectory xp[t] and released key trajectory xn[t] do not set any limit to the technical scope of the present invention. A trajectory for the depressed key 10*a* or 10*b* and a trajectory for the released key 10*a* or 10*b* may be given as an equation.

The additional key motion determiner 380 may not supply the piece of information to the key motion instructor 340 but to the electronic tone generator 140*a*. In this instance, the automatic player piano additionally produces the electronic tones instead of the acoustic piano tones.

The subtractor 360C may conditionally determine that all of the deviation parameters of deviation vector e[i] are zero. In other words, the performance rule changer 370C does not change the scheduled displacement vector g[i] in so far as the key 10*a* or 10*b* traveled on the reference key trajectory determined on the basis of the target driving vector r[i] without substantial fluctuation. If the deviation parameters etp[i], evp[i], etn[i] and evn[i] are less than predetermined values on the condition that the deviation parameter ek[i] is zero, the subtractor 360C determine that all of the deviation parameters of deviation vector e[i] are zero, or the performance rule changer 370C decreases the small values of deviation parameters etp[i], evp[i], etn[i] and evn[i] to zero.

Although the subtractor 360 compares the detected key motion vector y[i] with the target driving vector r[i] through the subtraction, the subtraction does not set any limit to the technical scope of the present invention. Another arithmetic operation, a set of arithmetic operations or another algorism for data processing may be employed for the determination of deviation vector e[i]. An example of the other arithmetic operation is a calculation for ratio between the target driving vector r[i] and the detected key motion vector y[i].

The performance rule changer 370E may change the scheduled deviation vector g[i] through an arithmetic operation different from the addition between the previous scheduled deviation vector g[m] and the deviation vector e[m]. For example, the scheduled vector g[m+1] may be determined through the subtraction between the previous scheduled vector g[m]−e[m]. In this instance, the passage proceeds in the direction opposite to the key depressed by the human player.

The parameters expressing the reference key trajectory may be unchanged.

In case where a human player depresses a white key 10*a* or a black key 10*b* assigned the key number k identical with the key number k defined in the target driving vector r[i], the white key 10*a* or black key 10*b* depressed by the human player may travel on a trajectory, an initial stage of which is different from the corresponding stage of the reference key trajectory defined on the basis of the target driving vector r[i]. In this situation, the motion controller may instruct the servo controller to stop the movement of the key 10*a* or 10*b* so that the key 10*a* or 10*b* is moved by the finger of human player. The initial stage may be equivalent to 10 milliseconds. Thus, the key 10*a* or 10*b* depressed by the human player has priority to the key 10*a* or 10*b* expressed by the target driving vector r[i].

The details of movements of keys 10*a* and 10*b* may be recorded in the random access memory 13 or disk driver 120.

In the first embodiment, the performance rule defines the target driving vector r[m+1] as the sum of the detected key motion vector y[i] and the scheduled displacement vector g[m+1], i.e., r[m+1]=y[m]+g[m+1]. Another performance rule may be employed in an automatic playing system of the present invention. For example, only white keys 10*a* or only black keys 10*b* may be driven in accordance with another performance rule. Yet another performance rule may be established on the tonality of major keys, the tonality of minor keys, the range in fifth or an ethnic scale such as the miyakogushi scale, ritsu scale of Japan, ryukyu scale of Japan or minyo scale of Japan. D, Eb, G, A, Bb D form the miyakobushi scale.

A stop instruction may be conditionally given to the motion controller. When a user gives the stop instruction to the information processing unit 110*a* through the display panel 130, when at least one parameter of target driving vector r[i] reaches an upper limit or a lower limit, when a user moves predetermined keys 10*a* and 10*b* or a predetermined combination of key and pedal, or when the user moves a key or keys in a predetermined manner, the information processing unit 110*a* stops or terminates the passage performance. For example, the user starts to depress a certain key 10*a* or 10*b* before depressing the key expressed by the target driving vector r[m], and the user remains the certain key 10*a* or 10*b* depressed until the user releases the key expressed by the target driving vector r[m]. The user may depresses a certain key 10*a* or 10*b* before releasing the key expressed by the target driving vector r[m] and remains the certain key 10*a* or 10*b* depressed until the depressed key time tp defined in the next target driving vector r[m+1].

In the examples shown in FIGS. 8, 11 and 14, each of the automatic playing systems 110, 110A and 110B drives a single key 10*a* or 10*b* at every depressed key time tp. However, this feature does not set any limit to the technical scope of the present invention. Another automatic playing system of the present invention may concurrently drive more than one key 10*a*/10*b* at each of the predetermined depressed key time tp for generating a chord. In this instance, the motion controller may further compare the details of movement driven by a human player with the details of movements driven by the servo controller through a predetermined data processing so as to change the performance rule.

The automatic player pianos 100, 100A, 100B, 100C, 100D and 100E do not set any limit to the technical scope of the present invention. The present invention may appertain to an electronic keyboard equipped with an array of solenoid-operated key actuators or an electronic piano equipped with the automatic playing system.

The electronic tone generating system 140 is not any indispensable element of the keyboard musical instrument of the present invention. A keyboard musical instrument of the present invention may be equipped with a mute system. The mute system has a hammer stopper provided in a space between the array of hammers and the string, and the hammer stopper is changed between a free position and a blocking position. While the hammer stopper is staying at the free position, the hammers 25 are brought into collision with the associated strings 40 for generating acoustic piano tones. When the hammer stopper is changed to the blocking position, the hammer stopper prevents the strings 40 from the collision with the hammers 25. Although the hammers 25 can escape from the action units 20 in response to the depressed keys 10*a* and 10*b*, the hammers 25 rebound on the hammer stopper before the collision with the strings 40 so that any acoustic piano tone is not generated. The information processing unit 110*a* may generate MIDI music data codes on the basis of the pieces of key position data so as to make it possible to generate electronic tones instead of the acoustic piano tones through the electronic tone generating system 140.

Claim languages are correlated with the component parts, software modules and software block of the automatic player piano 1, 1A, 1B, 1C, 1D and 1E as follows.

The keyboard 10 is corresponding to "a keyboard", and the white keys 10*a* and black keys 10*b* are corresponding to "plural keys". The action units 20, hammers 24, dampers 30 and strings 40 as a whole constitute "a tone generating system. It is possible to use the electronic tone generating system 140 as the "tone generating system" in the automatic player piano equipped with the mute system.

The servo controller 400/400A/400B/400C/400D/400E, pulse width modulators 150, solenoid-operated key actuators 50*a* serve as "a key driving system", and the glissando is "a part of said music tune." The key sensors 61, analog-to-digital converters 161 and key motion analyzer 200/200A/200B/200C/200D/200E serve as "a key motion reporter." The performance parameters k, tp, vp, tn, vn are corresponding to "performance parameters."

The performance rule table 310, initial parameter table 320, key determiner 330, key motion instructor 340, counter 350/350C and subtractor 360/360B/360C/360D serve as "a key motion controller", and the target driving vectors r[i], scheduled displacement vector g[i] and detected actual key motion vectors y[i] are corresponding to "target driving vectors", "scheduled displacement vector" and "detected actual key motion vector", respectively.

The performance rule changer 370/370C/370E serves as "a performance rule changer." The deviation vectors e[i] are corresponding to "difference between the target driving vectors . . . and the detected key motion vectors."

The information processing unit 110*a* and jobs at steps 210, 220 and 230 realizes "an interrupter", and the limiter 380 and limiting value table 381 serve as "a limiter."

The key number k, depressed key time tp, depressed key velocity vp, released key time tn and released key velocity vn are corresponding to "a key number", "a depressed key time", "a depressed key velocity", "a released key time" and "a released key velocity", respectively, and the rest position and end position are examples of "an upper position" and "a lower position", respectively.

The end position arrival time tpe, depressed key trajectory xp[t], rest position arrival time tnr and released key trajectory xn[t] are corresponding to "a key arrival time", "a key position", "another key arrival time" and "another key position", respectively.

The additional key motion determiner 380 serves as "an additional key motion determiner."

What is claimed is:

1. A keyboard musical instrument used for a performance of a music tune, comprising:

a keyboard including plural keys independently moved by a human player, and used for specifying tones to be produced;

a tone generating system connected to said plural keys, and generating said tones specified through the moved keys;

a key driving system provided for said plural keys, and selectively driving said plural keys without manipulation on said plural keys carried out by said human player on the basis of target key motion vectors expressing target movements of the keys to be moved for performing a part of said music tune;

a key motion reporter monitoring said plural keys, and producing performance parameters expressing actual movements of said keys moved by said key driving system and said human player;

a key motion controller connected to said key driving system and said key motion reporter, and determining said target driving vectors for said keys to be moved on the basis of scheduled displacement vectors each expressing a displacement from the movement of the key previously moved by said key driving system or said human player to the movement of one of said keys to be moved and detected key motion vectors produced from said performance parameters and expressing said actual movements; and a performance rule changer connected to said key motion controller, and changing said scheduled key motion vectors for the keys to be moved on the basis of difference between said target driving vectors expressing the target movements of the keys moved by said key driving system and said human player and said detected key motion vectors expressing said actual movements of said keys moved by said key driving system and said human player.

2. The keyboard musical instrument as set forth in claim 1, in which said key motion controller includes an interrupter causing said key driving system to cancel said target driving vectors for the keys on the condition that said human player starts to depress said keys before said key driving system starts to move said keys.

3. The keyboard musical instrument as set forth in claim 1, in which said key motion controller includes a limiter checking said target driving vectors to determine whether or not values of said target driving vectors are fallen within the ranges between upper limiting values and lower limiting values and restricting said target driving vectors to said upper limiting values or said lower limiting values when said values of target driving vectors are found out of said ranges.

4. The keyboard musical instrument as set forth in claim 1, in which said key motion controller an interrupter causing said key driving system to cancel said target driving vectors for the keys on the condition that said human player starts to depress said keys before said key driving system starts to move said keys, and a limiter checking said target driving vectors to determine whether or not values of said target driving vectors are fallen within the ranges between upper limiting values and lower limiting values and restricting said target driving vectors to said upper limiting values or said lower limiting values when said values of target driving vectors are found out of said ranges.

5. The keyboard musical instrument as set forth in claim 1, in which said performance parameters express a key number assigned to each of said plural keys, a depressed key time at which said each of said plural keys starts to travel from an upper position of a trajectory, a depressed key velocity expressing velocity of said each of said plural keys traveling from said upper position, a released key time at which said each of said plural keys starts to travel from an lower position of said trajectory, and a released key velocity expressing the velocity of said each of said plural keys traveling from said lower position, and in which each of said scheduled displacement vectors, each of said target driving vectors and each of said detected key motion vectors have scheduled key motion parameters corresponding to said performance parameters, driving parameters corresponding to said performance parameters and actual key motion parameters corresponding to said performance parameters, respectively.

6. The keyboard musical instrument as set forth in claim 5, in which said each of said plural keys is presumed to take uniform motion on said trajectory.

7. A keyboard musical instrument used for an automatic performance, comprising:

a keyboard including plural keys independently moved for specifying tones to be produced;

a tone generating system connected to said plural keys, and generating said tones specified through the moved keys;

a key driving system provided for said plural keys, and selectively driving said plural keys without manipulation of a human player on said plural keys on the basis of target key motion vectors expressing target movements of the keys to be moved for performing said music tune, the keys moved by said key driving system taking non-uniform motion;

a key motion reporter monitoring said plural keys, and producing performance parameters expressing actual movements of said keys moved by said key driving system;

a key motion controller connected to said key driving system and said key motion reporter, and determining said target driving vectors for said keys to be moved on the basis of scheduled displacement vectors each expressing a displacement from the movement of the key previously moved by said key driving system to the movement of one of said keys to be moved and difference between said target driving vectors and detected key motion vectors produced from said performance parameters and expressing said actual movements; and a performance rule changer connected to said key motion controller, and changing said scheduled key motion vectors for the keys to be moved on the basis of said scheduled key motion vectors for the keys already moved and said difference between said target driving vectors and said detected key motion vectors.

8. The keyboard musical instrument as set forth in claim 7, in which said performance parameters further express a key arrival time at which said each of said plural keys arrives at said lower position on said trajectory, a key position varied with time on said trajectory from said upper position on said trajectory, another key arrival time at which said each of said plural keys arrives at said upper position on said trajectory and another key position varied with time on said trajectory from said lower position on said trajectory instead of said depressed key velocity and said released key velocity, and in which each of said scheduled displacement vectors, each of said target driving vectors and each of said detected key motion vectors have scheduled key motion parameters corresponding to said performance parameters, driving parameters corresponding to said performance parameters and actual key motion parameters corresponding to said performance parameters, respectively.

9. A keyboard musical instrument used for a performance of a music tune, comprising:

a keyboard including plural keys independently moved by a human player, and used for specifying tones to be produced;

a tone generating system connected to said plural keys, and generating said tones specified through the moved keys;

a key driving system provided for said plural keys, and selectively driving said plural keys without manipulation on said plural keys by said human player on the basis of target key motion vectors expressing target movements of the keys to be moved for performing a part of said music tune;

a key motion reporter monitoring said plural keys, and producing performance parameters expressing actual movements of said keys moved by said key driving system and said human player;

a key motion controller connected to said key driving system and said key motion reporter, and determining said target driving vectors for said keys to be moved on the basis of scheduled displacement vectors each expressing a displacement from the movement of the key previously moved by said key driving system or said human player to the movement of one of said keys to be moved and the target driving vectors for the keys driven by said key driving system or said human player; and a performance rule changer connected to said key motion controller, and changing said scheduled key motion vectors for the keys to be moved on the basis of difference between said target driving vectors expressing the target movements of the keys moved by said key driving system and said human player and said detected key motion vectors expressing said actual movements of said keys moved by said key driving system and said human player.

10. A keyboard musical instrument used for a performance of a music tune, comprising:

a keyboard including plural keys independently moved by a human player, and used for specifying tones to be produced;

a tone generating system connected to said plural keys, and generating said tones specified through the moved keys;

a key driving system provided for said plural keys, and selectively driving said plural keys without a manipulation on said plural keys carried out by said human player on the basis of target key motion vectors expressing target movements of the keys to be moved for performing a part of said music tune;

a key motion reporter monitoring said plural keys, and producing performance parameters expressing actual movements of said keys moved by said key driving system and said human player;

a key motion controller connected to said key driving system and said key motion reporter, and determining said target driving vectors for said keys to be moved on the basis of scheduled displacement vectors each expressing a displacement from the movement of the key previously moved by said key driving system or said human player to the movement of one of said keys to be moved and detected key motion vectors produced from said performance parameters and expressing said actual movements; and an additional key motion determiner connected to said key motion controller and instructing said key driving system to drive the keys expressed in difference between said target driving vectors expressing the target movements of the keys moved by said key driving system and said human player and said detected key motion vectors expressing said actual movements of said keys moved by said key driving system and said human player.

* * * * *